US011969126B2

(12) United States Patent
Gill et al.

(10) Patent No.: US 11,969,126 B2
(45) Date of Patent: Apr. 30, 2024

(54) DEBRIS FIN FOR ROBOTIC CLEANER DUST CUP

(71) Applicant: SHARKNINJA OPERATING LLC, Needham, MA (US)

(72) Inventors: Aaron Gill, Needham, MA (US); Isaku D. Kamada, Brighton, MA (US); Rahat Khan, Needham, MA (US); Karthikeyan Subramani, Needham, MA (US); Hongbo Lin, Needham, MA (US)

(73) Assignee: SharkNinja Operating LLC, Needham, MA (US)

( * ) Notice: Subject to any disclaimer, the term of this patent is extended or adjusted under 35 U.S.C. 154(b) by 162 days.

(21) Appl. No.: 17/006,289

(22) Filed: Aug. 28, 2020

(65) Prior Publication Data

US 2021/0059495 A1 Mar. 4, 2021

Related U.S. Application Data

(60) Provisional application No. 63/013,188, filed on Apr. 21, 2020, provisional application No. 62/892,953, filed on Aug. 28, 2019.

(51) Int. Cl.
*A47L 11/40* (2006.01)
*A47L 9/14* (2006.01)

(52) U.S. Cl.
CPC ..... *A47L 11/4027* (2013.01); *A47L 9/1409* (2013.01); *A47L 2201/00* (2013.01)

(58) Field of Classification Search
CPC .. A47L 11/4027; A47L 2201/00; A47L 9/102; A47L 9/1409
See application file for complete search history.

(56) References Cited

U.S. PATENT DOCUMENTS

2003/0150198 A1* 8/2003 Illingworth ..... A47L 9/102 55/467
2004/0187249 A1* 9/2004 Jones ..... A47L 11/4066 15/319
2008/0047092 A1* 2/2008 Schnittman ..... A47L 11/4025 15/3

(Continued)

FOREIGN PATENT DOCUMENTS

CN 102793514 11/2012
CN 104433962 3/2015

(Continued)

OTHER PUBLICATIONS

PCT Search Report and Written Opinion, dated Nov. 20, 2020, received in corresponding PCT Application No. PCT/US20/48513, 9 pages.

(Continued)

*Primary Examiner* — Marc Carlson
(74) *Attorney, Agent, or Firm* — Grossman Tucker Perreault & Pfleger, PLLC

(57) ABSTRACT

A debris fin for a robotic cleaner dust cup may include a fin mount and an airflow body extending from the fin mount according to a divergence angle, the airflow body defining an airflow surface, the airflow body being configured to straighten fibrous debris entrained within air that is incident thereon.

26 Claims, 24 Drawing Sheets

(56) References Cited

U.S. PATENT DOCUMENTS

| | | | | |
|---|---|---|---|---|
| 2011/0225764 | A1* | 9/2011 | Muhlenkamp | A47L 9/1683 15/347 |
| 2013/0219654 | A1* | 8/2013 | Ruben | A47L 9/1608 15/347 |
| 2014/0109339 | A1* | 4/2014 | Won | A47L 9/0477 15/347 |
| 2014/0215751 | A1 | 8/2014 | Kasper et al. | |
| 2016/0058259 | A1* | 3/2016 | Mitchell | A47L 9/1633 15/353 |
| 2016/0198913 | A1* | 7/2016 | Oka | A47L 5/22 15/340.1 |
| 2018/0078106 | A1* | 3/2018 | Scholten | G01S 17/931 |
| 2018/0255991 | A1* | 9/2018 | Der Marderosian | A47L 9/0477 |
| 2018/0368634 | A1* | 12/2018 | Burr | A47L 9/104 |
| 2019/0298127 | A1* | 10/2019 | Hu | A47L 9/106 |

FOREIGN PATENT DOCUMENTS

| | | | | |
|---|---|---|---|---|
| CN | 108158489 | | 6/2018 | |
| CN | 208659188 | | 3/2019 | |
| EP | 3243416 | | 11/2017 | |
| EP | 3243416 | A1 * | 11/2017 | A47L 5/24 |
| JP | S55120836 | | 9/1980 | |
| JP | 2017000581 | | 1/2017 | |
| JP | 2017202050 | | 11/2017 | |
| JP | 2018061531 | | 4/2018 | |
| JP | 2018079292 | | 5/2018 | |
| WO | 2013105431 | | 7/2013 | |

OTHER PUBLICATIONS

Chinese Office Action with machine generated English translation dated Aug. 15, 2022, received in Chinese Patent Application No. 202080062112.3, 18 pages.

Chinese Office Action with machine-generated English translation issued Jun. 6, 2023, received in Chinese Patent Application No. 202080062112.3, 18 pages.

Japanese Office Action with English translation issued Jun. 13, 2023, received in Japanese Patent Application No. 2022-513199, 10 pages.

Canadian Office Action issued issued May 23, 2023, received in Canadian Patent Application No. 3,149,584, 3 pages.

Extended European Search Report issued Aug. 16, 2023, received in European Patent Application No. 20858269.2, 7 pages.

Chinese Office Action with machine generated English translation issued Dec. 4, 2023, received in Chinese Patent Application No. 202080062112.3, 8 pages.

* cited by examiner

DEBRIS FIN FOR ROBOTIC CLEANER DUST CUP

CROSS-REFERENCE TO RELATED APPLICATIONS

The present application claims the benefit of U.S. Provisional Application Ser. No. 62/892,953 filed on Aug. 28, 2019, entitled Debris Fin for Robotic Cleaner Dust Cup configured to Straighten Fibrous Debris Entrained within Air that is Incident thereon and U.S. Provisional Application Ser. No. 63/013,188 filed on Apr. 21, 2020, entitled Debris Fin for Robotic Cleaner Dust Cup configured to Straighten Fibrous Debris Entrained within Air that is Incident thereon, each of which are fully incorporated herein by reference.

TECHNICAL FIELD

The present disclosure is generally directed to automated cleaning apparatuses and more specifically to robotic cleaners having at least one dust cup.

BACKGROUND INFORMATION

Autonomous surface treatment apparatuses are configured to traverse a surface (e.g., a floor) while removing debris from the surface with little to no human involvement. For example, a robotic vacuum may include a controller, a plurality of driven wheels, a suction motor, a brush roll, and a dust cup for storing debris. The controller causes the robotic vacuum cleaner to travel according to one or more patterns (e.g., a random bounce pattern, a spot pattern, a wall/obstacle following pattern, and/or the like). While traveling pursuant to one or more patterns, the robotic vacuum cleaner collects debris in the dust cup. As the dust cup gathers debris, the performance of the robotic vacuum cleaner may be degraded. As such, the dust cup may need to be emptied at regular intervals to maintain consistent cleaning performance.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a dust cup for a robotic cleaner. The robotic cleaner dust cup includes a robotic cleaner dust cup inlet and a robotic cleaner dust cup outlet. A debris fin extends between a top surface and a bottom surface of the robotic cleaner dust cup in a direction transverse to a horizontal plane of the robotic cleaner dust cup. The debris fin is configured to engage debris suctioned into the robotic cleaner dust cup inlet during a cleaning operation. Engagement of the debris fin with fibrous debris (e.g., hair or string) may encourage a straightening and/or discourage an entangling of the fibrous debris entering the robotic cleaner dust cup. As a result, when the robotic cleaner dust cup is evacuated (e.g., using a docking station), debris may be more easily suctioned from the robotic cleaner dust cup outlet. Additionally, or alternatively, the debris fin may prevent at least a portion of the fibrous debris deposited within the robotic cleaner dust cup from exiting the robotic cleaner dust cup through the robotic cleaner dust cup inlet (e.g., by physically obscuring at least a portion of the robotic cleaner dust cup inlet and/or by increasing a flow velocity of air passing through the robotic cleaner dust cup inlet). Such a configuration may, for example, reduce a quantity of fibrous debris that becomes entangled on an agitator of the robotic cleaner. Accordingly, in some instances, the debris fin can generally be described as encouraging fibrous debris to migrate in a single direction within the robotic cleaner dust cup (e.g., from the robotic cleaner dust cup inlet towards the robotic cleaner dust cup outlet).

In some instances, the robotic cleaner dust cup may, for example, include a debriding rib configured to engage a portion of an agitator of the robotic cleaner. The engagement being configured such that at least a portion of fibrous debris entangled on the agitator can be removed therefrom. The debriding rib can be coupled to or integrally formed from one of a main body of the robotic cleaner dust cup (e.g., a base, top, or sidewall of the robotic cleaner dust cup) or the debris fin. When coupled to or integrally formed from the debris fin sound generated as a result of engagement between the agitator and the debriding rib may be reduced relative to when the debriding rib is coupled to or integrally formed from the main body of the robotic cleaner dust cup.

Figure 1:
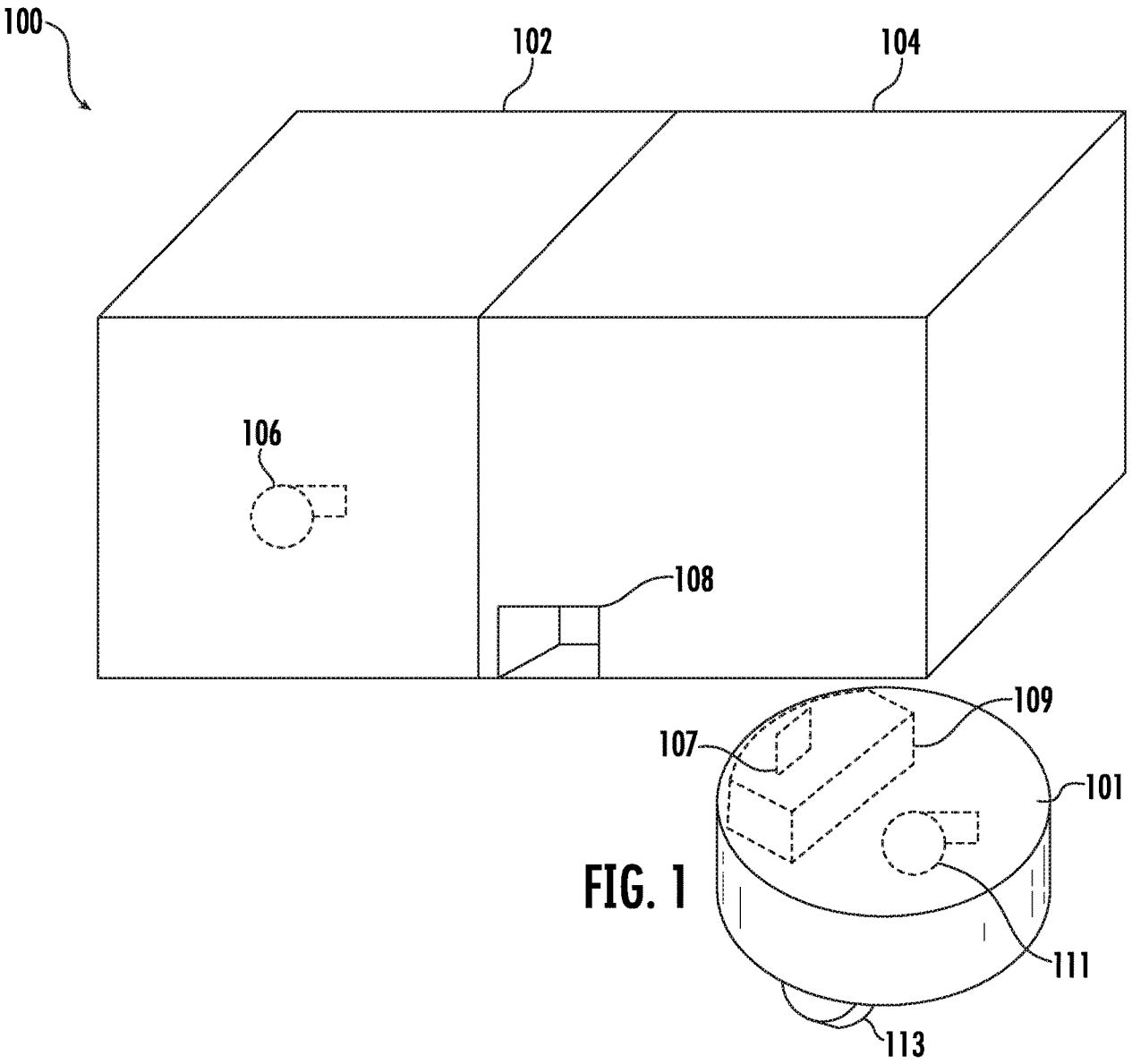
FIG. 1 shows a schematic example of a robotic cleaner and a robotic cleaner docking station, consistent with embodiments of the present disclosure.

FIG. 1 shows a schematic view of a docking station 100. The docking station 100 includes a base 102 and a docking station dust cup 104. The base 102 includes a dock suction motor 106 (shown in hidden lines) fluidly coupled to a docking station inlet 108 and the docking station dust cup 104. When the dock suction motor 106 is activated, fluid is caused to flow into the docking station inlet 108, through the docking station dust cup 104, and exit the base 102 after passing through the dock suction motor 106.

The docking station inlet 108 is configured to fluidly couple to a robotic cleaner 101 (e.g., a robotic vacuum cleaner, a robotic mop, and/or any other robotic cleaner). The robotic cleaner 101 may include a robotic cleaner dust cup 109 (shown in hidden lines) having an outlet port 107 (shown in hidden lines), a robotic cleaner suction motor 111 (shown in hidden lines) fluidly coupled to the robotic cleaner dust cup 109, and one or more driven wheels 113 configured to urge the robotic cleaner 101 over a surface. For example, the docking station inlet 108 can be configured to fluidly couple to an outlet port 107 (shown in hidden lines) provided in a robotic cleaner dust cup 109 (shown in hidden lines) such that debris stored in the dust cup of the robotic cleaner 101 can be transferred into the docking station dust cup 104. When the dock suction motor 106 is activated, the dock suction motor 106 causes debris stored in the robotic cleaner dust cup 109 to be urged into the docking station dust cup 104. The debris may then collect in the docking station dust cup 104 for later disposal. The docking station dust cup 104 may be configured such that the docking station dust cup 104 can receive debris from the robotic cleaner dust cup 109 multiple times (e.g., at least two times) before the docking station dust cup 104 becomes full (e.g., the performance of the docking station 100 is substantially degraded). In other words, the docking station dust cup 104 may be configured such that the robotic cleaner dust cup 109 can be emptied several times before the docking station dust cup 104 becomes full.

In some instances, the robotic cleaner 101 can be configured to perform one or more wet cleaning operations (e.g., using a mop pad and/or a fluid dispensing pump). Additionally, or alternatively, the robotic cleaner 101 can be configured to perform one or more vacuum cleaning operations.

Figure 2:
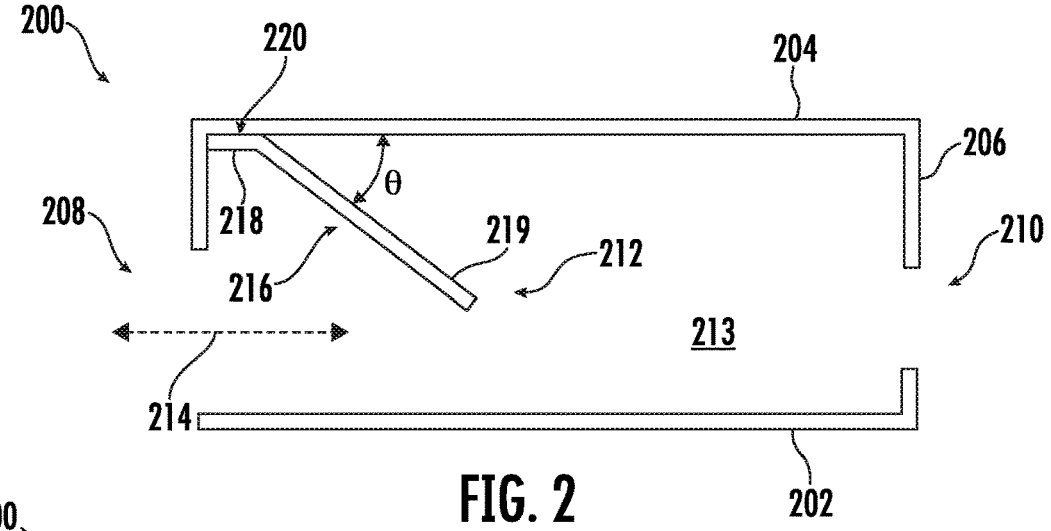
FIG. 2 shows a schematic example of a robotic cleaner dust cup, consistent with embodiments of the present disclosure.

FIG. 2 shows a schematic example of a robotic cleaner dust cup 200, which may be an example of the robotic cleaner dust cup 109 of FIG. 1. As shown, the robotic cleaner dust cup 200 includes a dust cup base 202, a dust cup top 204, and one or more dust cup sidewalls 206 extending between the dust cup base 202 and the dust cup top 204. A robotic cleaner dust cup inlet 208 and a robotic cleaner dust cup outlet 210 are defined in a corresponding one of the one or more dust cup sidewalls 206. For example, and as shown, the robotic cleaner dust cup inlet 208 and the robotic cleaner dust cup outlet 210 may be defined in opposing sidewalls 206.

As shown, at least a portion of a debris fin 212 extends within a dust cup cavity 213 between the dust cup top 204 and the dust cup base 202 in a direction toward the dust cup base 202 (e.g., a direction transverse to a central axis 214 of the robotic cleaner dust cup inlet 208). In other words, the debris fin 212 extends in a direction transverse to a horizontal plane of the robotic cleaner dust cup 200. As such, air flowing through the robotic cleaner dust cup inlet 208 (e.g., during a cleaning operation) is incident on an airflow body 219 of the debris fin 212 causing the air incident thereon to be urged towards the dust cup base 202 and along an airflow surface 216 of the airflow body 219. The airflow body 219 (e.g., airflow surface 216) can be configured to cause fibrous debris (e.g., hair or string) entrained within air flowing over the airflow surface 216 to be straightened (e.g., detangled).

The debris fin 212 may include a fin mount 218. The fin mount 218 is configured to couple the debris fin 212 to the robotic cleaner dust cup 200. For example, and as shown, the fin mount 218 can be configured to couple to the dust cup top 204. The airflow body 219 extends from the fin mount 218 in a direction away from the dust cup top 204 and towards the dust cup base 202 according to a divergence angle $\Theta$ extending between the airflow body 219 and the dust cup top 204. In other words, the divergence angle $\Theta$ extends between a plane (e.g., a horizontal plane) defined by a mounting surface 220 of the fin mount 218 and the airflow body 219. The divergence angle $\Theta$ may be constant or non-constant along a length of the debris fin 212.

Figure 3:
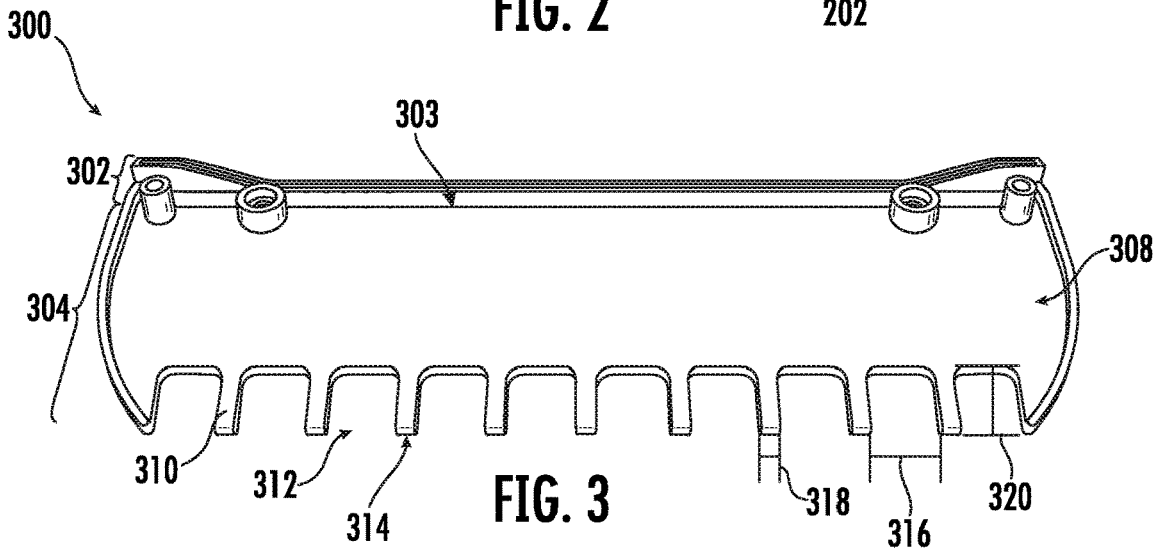
FIG. 3 shows a perspective view of an example of a debris fin, consistent with embodiments of the present disclosure.
Figure 4:
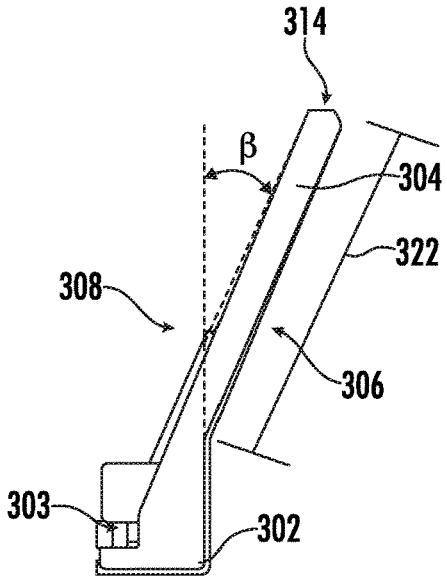
FIG. 4 shows an end view of the debris fin of FIG. 3, consistent with embodiments of the present disclosure.

FIG. 3 shows a perspective view of a debris fin 300, which may be an example of the debris fin 212. FIG. 4 shows an end view of the debris fin 300.

As shown, the debris fin 300 includes a fin mount 302 and an airflow body 304 extending from the fin mount 302 according to a divergence angle $\beta$. The fin mount 302 defines a mounting surface 303 configured to engage a robotic cleaner dust cup such that the fin mount 302 can be coupled to the robotic cleaner dust cup. The airflow body 304 defines an airflow surface 306 on which air entering a robotic cleaner dust cup is incident and a dust cup top facing surface 308 opposite the airflow surface 306. The divergence angle β is measured between the dust cup top facing surface 308 and a plane (e.g., a horizontal plane) defined by the mounting surface 303 of the fin mount 302. In some instances, for example, the divergence angle Θ may measure in a range of 20° to 40°.

The airflow body 304 defines a trailing edge 314 that is spaced apart from the fin mount 302 such that the trailing edge 314 is at the distal most portion of the airflow body 304. The trailing edge 314 can define a wave shape such as, for example, a square wave shape, as shown. In other words, the airflow body 304 may include a plurality of teeth 310 spaced apart from each other by a plurality of cutouts 312 extending through the airflow body 304. As such, the airflow body 304 may generally be described as defining a comb. Fibrous debris entrained within air flowing between the teeth 310 and through the cutouts 312 may be caused to be straightened (e.g., detangled) as a result of the engagement of the fibrous debris with the teeth 310.

A cutout width 316 extending between two adjacent teeth 310 may measure, for example, in a range of 5 millimeters (mm) to 15 mm. By way of further example, the cutout width 316 may measure 10 mm. A tooth thickness 318 extending between opposing sides of a respective tooth 310 may measure, for example, in a range of 3 mm to 5 mm. By way of further example, the tooth thickness 318 may measure 3 mm. A tooth length 320 extending between a portion of the trailing edge 314 defined by a respective tooth 310 and a portion of the trailing edge 314 defined by a respective cutout 312 may measure, for example, in a range of 10 mm to 15 mm. By way of further example, the tooth length 320 may measure 10 mm. An airflow body length 322 extending between a distal most portion of the airflow body 304 (e.g., a portion of the trailing edge 314 defined by a respective tooth 310) and the fin mount 302 may measure, for example, in a range of 25 mm to 40 mm.

Figure 5:
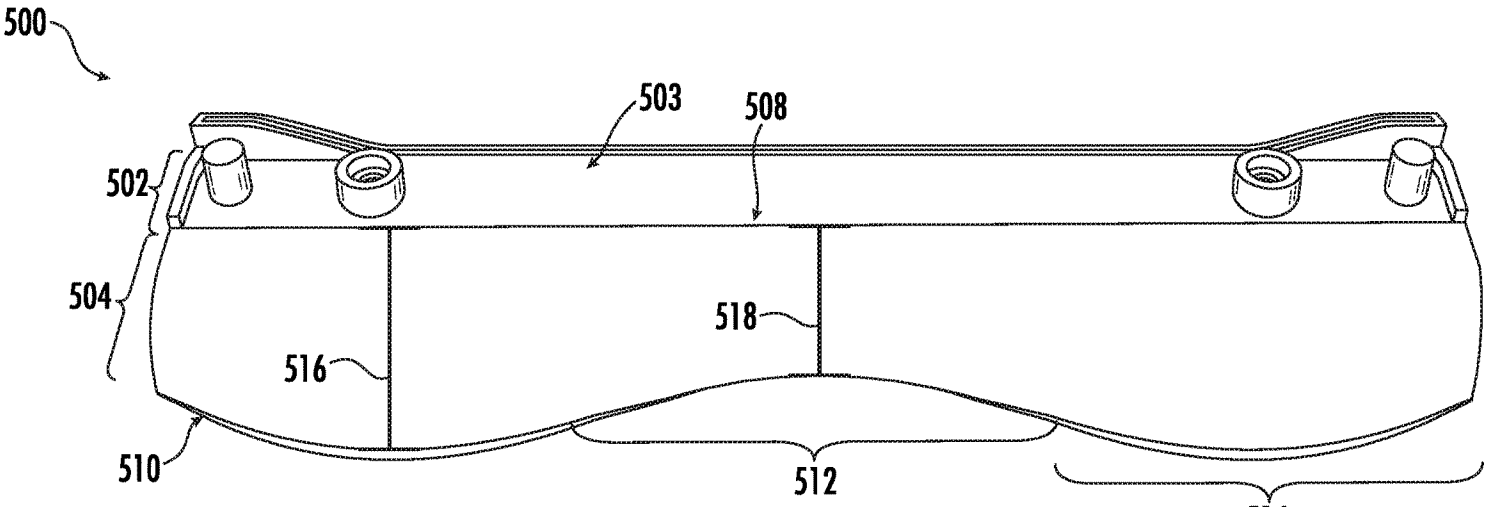
FIG. 5 shows a perspective view of an example of a debris fin, consistent with embodiments of the present disclosure.
Figure 6:
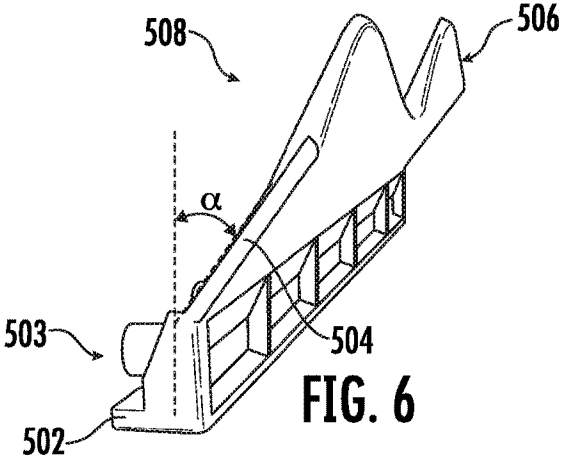
FIG. 6 shows a perspective end view of the debris fin of FIG. 5, consistent with embodiments of the present disclosure.

FIG. 5 shows a perspective view of a debris fin 500, which may be an example of the debris fin 212. FIG. 6 shows a perspective end view of the debris fin 500.

As shown, the debris fin 500 includes a fin mount 502 and an airflow body 504 extending from the fin mount 502. The fin mount 502 defines a mounting surface 503 configured to engage a robotic cleaner dust cup such that the fin mount 502 can be coupled to the robotic cleaner dust cup. The airflow body 504 defines an airflow surface 506 on which air entering a robotic cleaner dust cup is incident and a dust cup top facing surface 508 opposite the airflow surface 506.

Figure 7:
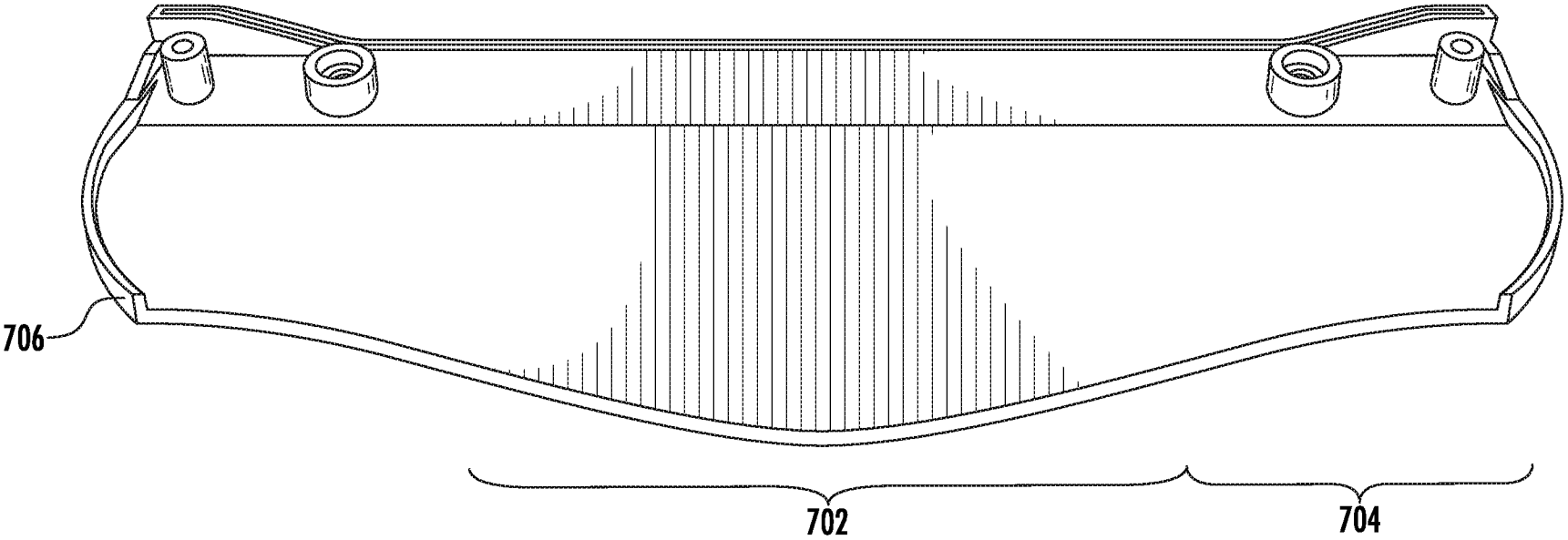
FIG. 7 shows a perspective view of an example of a debris fin, consistent with embodiments of the present disclosure.

The airflow body 504 defines a trailing edge 510 that is spaced apart from the fin mount 502 such that the trailing edge 510 is the distal most portion of the airflow body 304. The trailing edge 510 can define a wave shape such as, for example, a curved wave shape, as shown. In other words, the airflow body 504 can include one or more concave regions 512 and one or more convex regions 514. As shown, the concave region 512 extends between a plurality of convex regions 514. In some instances, and as shown, for example, in FIG. 7, a convex region 702 may extend between two concave regions 704, wherein the convex region 702 is centered along an airflow body 706.

The airflow body 504 may be non-planar. For example, the airflow body 504 may define a wave shape such as, for example, a curved wave shape, as shown. In other words, the airflow body 504 may be corrugated such that the airflow surface 506 defines a wave shape. As such, the airflow body 504 may include two or more curved wave shapes, wherein a first curved wave shape extends in a first plane and a second curved wave shape extends in a second plane, the first plane extending transverse to (e.g., perpendicular to) the second plane. In these instances, the airflow body 504 can extend from the fin mount 502 according to a non-constant divergence angle α measured between the dust cup top facing surface 508 and a plane (e.g., a horizontal plane) defined by the mounting surface 503 of the fin mount 502. For example, the divergence angle α corresponding to the one or more convex regions 514 may measure, for example, in a range of 0° to 30° and a measure of the divergence angle α corresponding to the one or more concave regions 512 may measure, for example, in a range of 20° to 40°.

A measure of a maximum airflow body convex length 516 corresponding to the one or more convex regions 514 (as measured from a distal most portion of a respective convex region 514 to the fin mount 502) may, for example, be in a range of 30 mm to 40 mm and a measure of a maximum airflow body concave length 518 corresponding to one or more of the concave regions 512 (as measured from a proximal most portion of a respective convex region 512 to the fin mount 502) may, for example, be in a range of 25 mm to 40 mm.

Figure 8:
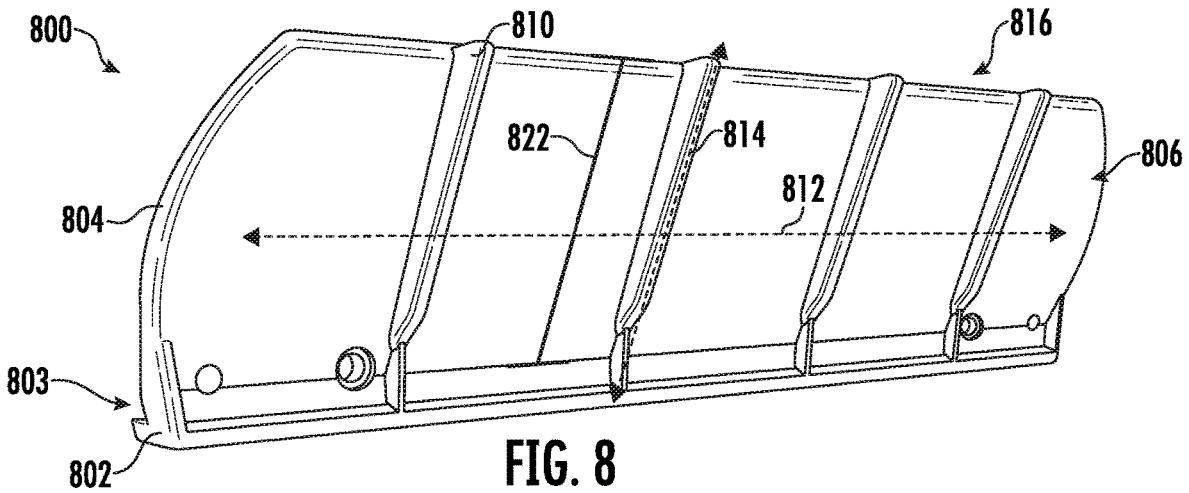
FIG. 8 shows a perspective view of an example of a debris fin, consistent with embodiments of the present disclosure.
Figure 9:
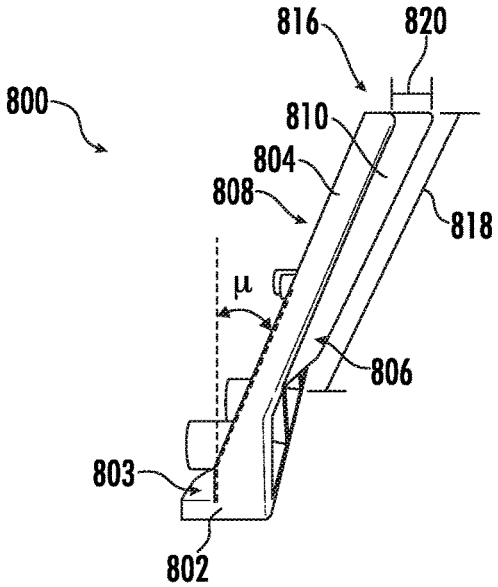
FIG. 9 shows an end view of the debris fin of FIG. 8, consistent with embodiments of the present disclosure.

FIG. 8 shows a perspective view of a debris fin 800, which may be an example of the debris fin 212. FIG. 9 shows an end view of the debris fin 800.

As shown, the debris fin 800 includes a fin mount 802 and an airflow body 804 extending from the fin mount 802 according to a divergence angle μ. The fin mount 802 defines a mounting surface 803 configured to engage a robotic cleaner dust cup such that the fin mount 802 can be coupled to the robotic cleaner dust cup. The airflow body 804 defines an airflow surface 806 on which air entering a robotic cleaner dust cup is incident and a dust cup top facing surface 808 opposite the airflow surface 806. The divergence angle μ is measured between the dust cup top facing surface 808 and a plane (e.g., a horizontal plane) defined by the mounting surface 803 of the fin mount 802. In some instances, for example, the divergence angle μ may measure in a range of 20° to 40°.

The airflow body 804 can include one or more ribs 810 extending from the airflow surface 806. For example, the airflow body 804 may include one, two, three, four, five, six, seven, eight, and/or any other suitable number of ribs 810. The one or more ribs 810 extend generally parallel to a flow direction of air along the airflow surface 806. When there are two or more ribs 810, the ribs 810 may be spaced apart from each other along the airflow surface 806 such that fibrous debris moving along the airflow surface 806 is straightened as a result of, for example, engagement with the ribs 810. In some instances, and as shown, two or more ribs 810 may be spaced longitudinally along a body longitudinal axis 812 of the airflow body 804 such that a rib longitudinal axis 814 of the ribs 810 extends transverse to (e.g., perpendicular to) the body longitudinal axis 812. In some instances, when there are a plurality of ribs 810, at least two of the ribs 810 may extend parallel to each other.

The one or more ribs 810 may extend continuously from a trailing edge 816 of the airflow body 804 to the fin mount 802. In some instances, one or more of the one or more ribs 810 may extend over at least a portion of the fin mount 802. A rib length 818 extending from the trailing edge 816 to the fin mount 802 may measure, for example, in a range of 25 mm to 40 mm. A measure of a rib height 820 extending from the airflow surface 806 of the airflow body 804 may be in a range of, for example, 4 mm to 8 mm. An airflow body length 822 extending from a distal most portion of the airflow body 804 to the fin mount 802 may measure in a range of, for example, 25 mm to 40 mm.

Figure 10:
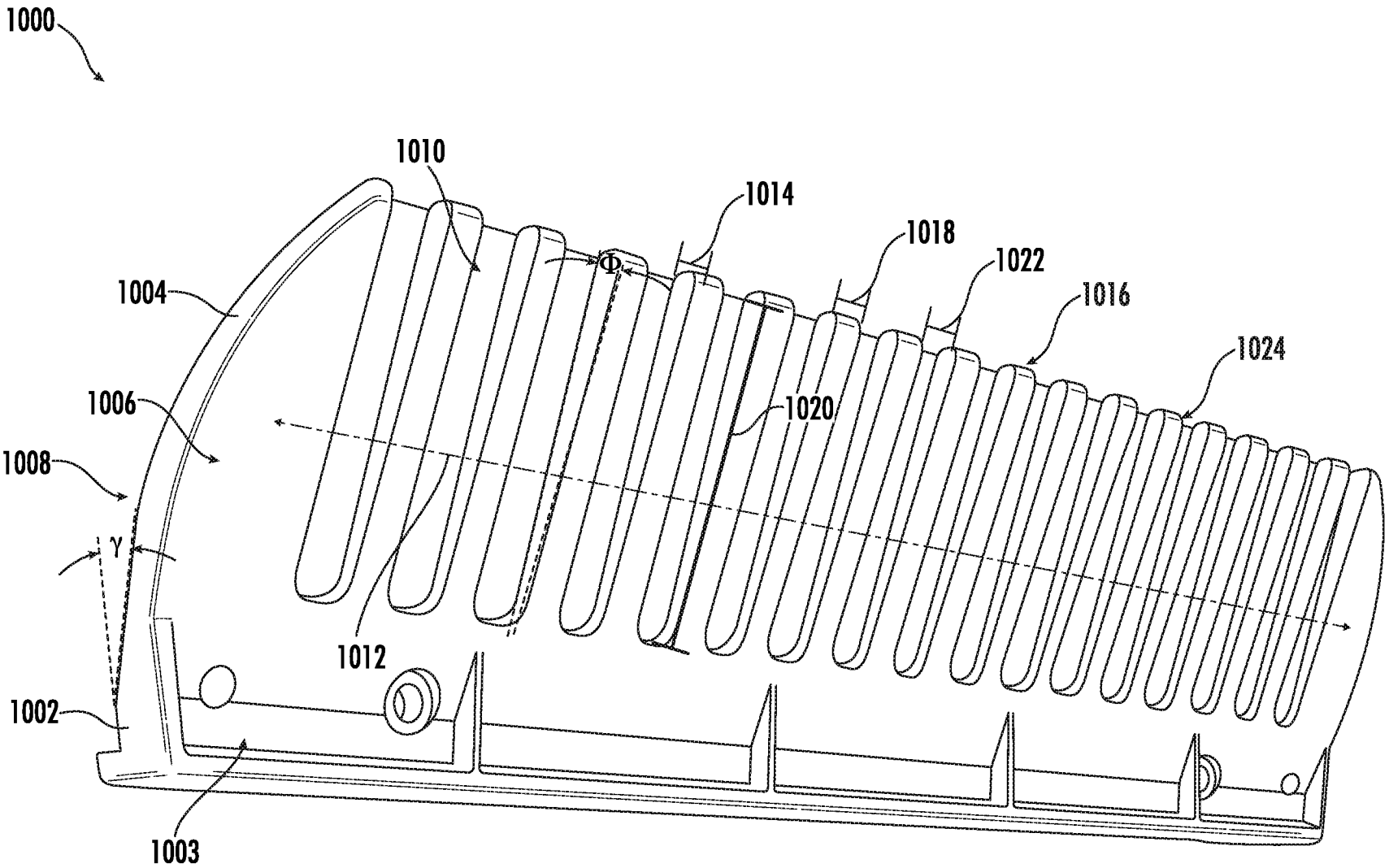
FIG. 10 shows a perspective view of an example of a debris fin, consistent with embodiments of the present disclosure.

FIG. 10 shows a perspective view of a debris fin 1000, which may be an example of the debris fin 212. As shown, the debris fin 1000 includes a fin mount 1002 and an airflow body 1004 extending from the fin mount 1002 according to a divergence angle γ. The fin mount 1002 defines a mounting surface 1003 configured to engage a robotic cleaner dust cup such that the fin mount 1002 can be coupled to the robotic cleaner dust cup. The airflow body 1004 defines an airflow surface 1006 on which air entering a robotic cleaner dust cup is incident and a dust cup top facing surface 1008 opposite the airflow surface 1006. The divergence angle γ is measured between the dust cup top facing surface 1008 and a plane (e.g., a horizontal plane) defined by the mounting surface 1003 of the fin mount 1002. In some instances, for example, the divergence angle γ may measure in a range of 20° to 40°.

As shown, the airflow body 1004 may include one or more grooves 1010 that are defined in the airflow surface 1006. The one or more grooves 1010 extend along the airflow surface 1006 in a direction transverse to (e.g., perpendicular to) a body longitudinal axis 1012. In other words, the one or more grooves 1010 may extend generally parallel to an airflow direction along the airflow surface 1006.

A measure of a groove depth 1014 may decrease with increasing distance from a trailing edge 1016 of the airflow body 1004. For example, a measure of the groove depth 1014 may decrease from 3 mm at a location proximate the trailing edge 1016 to 1 mm at a location proximate the fin mount 1002. Additionally, or alternatively, the one or more grooves 1010 may have a groove taper angle ϕ (as measured between a closed bottom surface and an opposing open end of a corresponding groove 1010) that measures, for example, in range of 2° to 15°. In some instances, the groove depth 1014 may be substantially constant along a respective groove 1010. A groove width 1018 extending between opposing sides of a corresponding groove 1010 may measure, for example, in a range of 3 mm to 5 mm. A groove length 1020 extending from the trailing edge 1016 and in a direction along a corresponding groove 1010 towards the fin mount 1002 may measure in a range of, for example, 5 mm to 35 mm. When two or more grooves 1010 are defined in the airflow surface 1006, a groove spacing 1022 extending between adjacent grooves 1010 may measure, for example, in a range of 3 mm to 10 mm.

As shown, the airflow body 1004 may define a convex fillet 1024 that extends along at least a portion of the trailing edge 1016. Such a configuration may result in a comb being defined along the trailing edge 1016. A tooth length corresponding to the teeth of the resulting comb may be based, at least in part, on the groove depth 1014.

Figure 11:
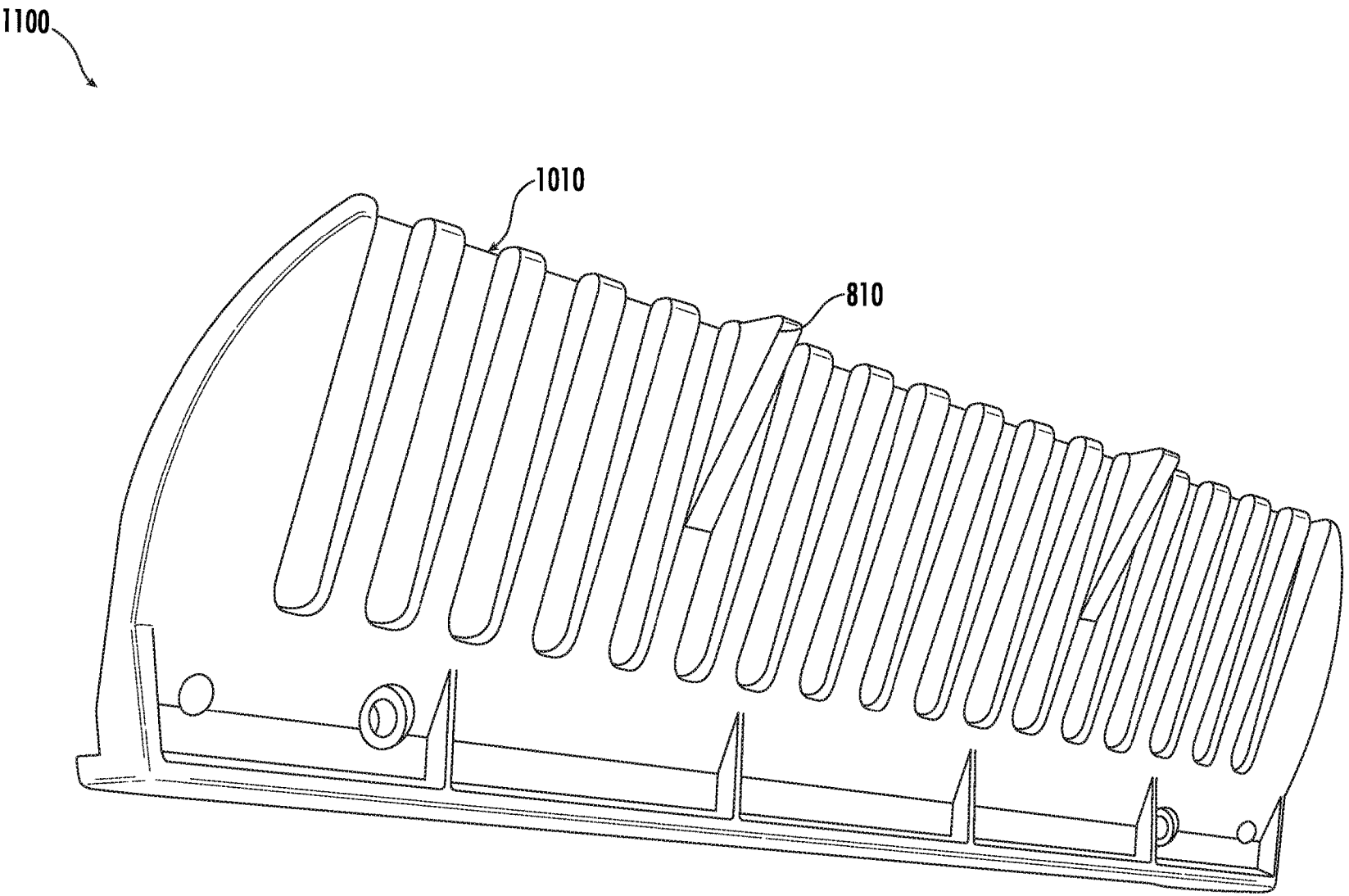
FIG. 11 shows a perspective view of an example of a debris fin, consistent with embodiments of the present disclosure.

As may be appreciated, the debris fin 212 of FIG. 2 may include combinations of one or more of the features described herein, for example, one or more of the features described in relation to FIGS. 3-10. For example, and as shown in FIG. 11, a debris fin 1100 (which may be an example of the debris fin 212) may include the one or more grooves 1010 and the one or more ribs 810.

Figure 12:
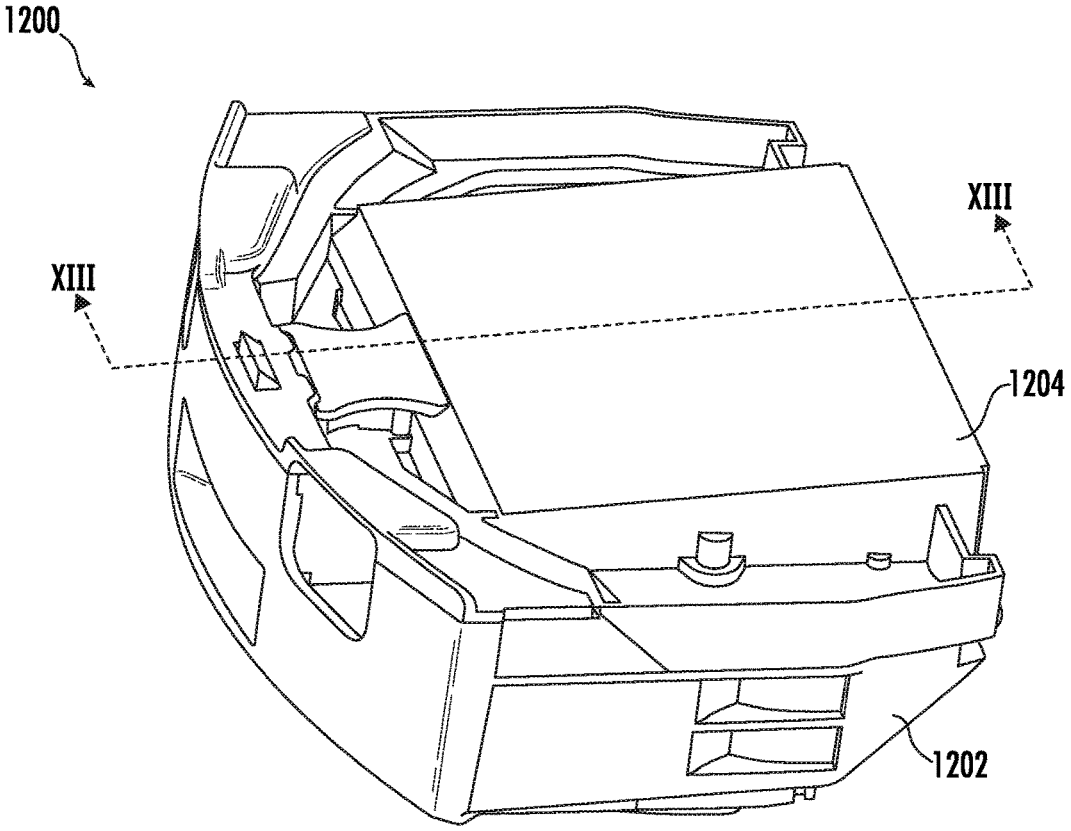
FIG. 12 shows a perspective view of an example of a robotic cleaner dust cup, consistent with embodiments of the present disclosure.

FIG. 12 shows a perspective view of a robotic cleaner dust cup 1200, which may be an example of the robotic cleaner dust cup 200 of FIG. 2. As shown, the robotic cleaner dust cup 1200 includes a dust cup body 1202 and an openable door 1204 moveably coupled (e.g., pivotally coupled) to the dust cup body 1202, the openable door 1204 defining a top of the robotic cleaner dust cup 1200. The robotic cleaner dust cup 1200 may include a debris fin such as the debris fin 212 of FIG. 2 extending within the dust cup body 1202.

Figure 13:
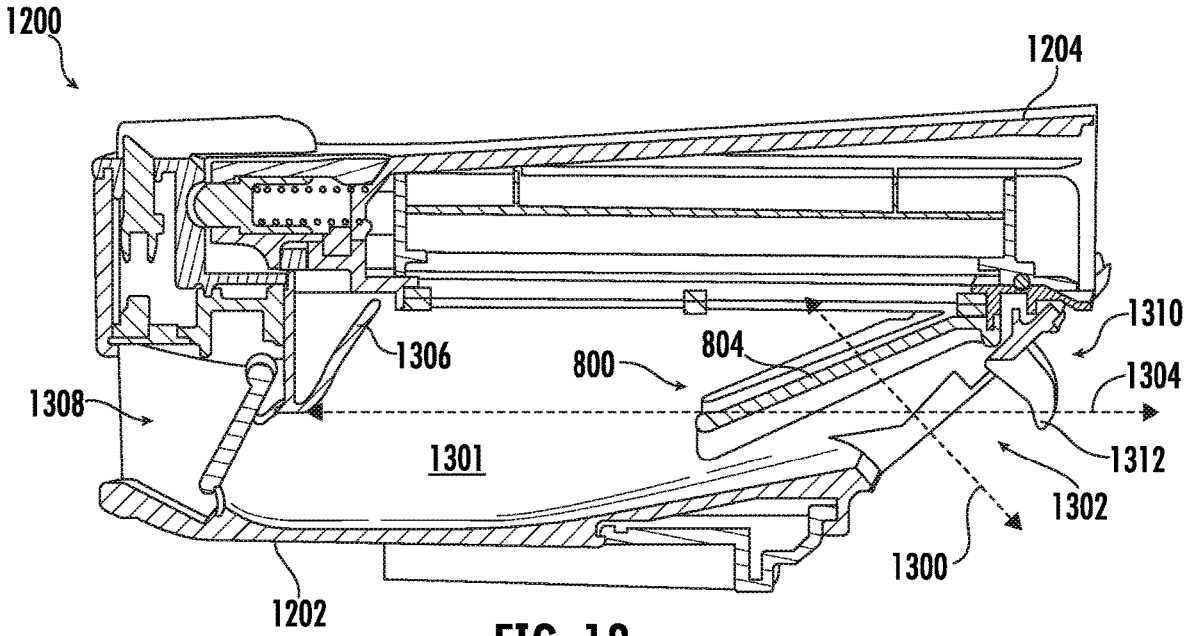
FIG. 13 shows a cross-sectional view of an example of the robotic cleaner dust cup of FIG. 12 taken along the line XIII-XIII, consistent with embodiments of the present disclosure.

For example, as shown in FIG. 13 (which is a cross-sectional view of an example of the robotic cleaner dust cup 1200 taken along the line XIII-XIII of FIG. 12), the robotic cleaner dust cup 1200 may include the debris fin 800 of FIG. 8 extending within a dust cup cavity 1301 of the robotic cleaner dust cup 1200. As shown, the airflow body 804 of the debris fin 800 extends transverse to a dust cup inlet central axis 1300 of a robotic cleaner dust cup inlet 1302. As such, in some instances, the debris fin 800 may at least partially occlude a portion of the robotic cleaner dust cup inlet 1302. In these instances, a velocity of air flowing through the robotic cleaner dust cup inlet 1302 may be increased.

The robotic cleaner dust cup inlet 1302 can extend transverse to a dust cup horizontal axis 1304 at a non-perpendicular angle. As such, the dust cup inlet central axis 1300 extends transverse to the dust cup horizontal axis 1304 at a non-perpendicular angle. Such a configuration may improve an ability of debris to be urged into the robotic cleaner dust cup inlet 1302 by, for example, a rotating agitator such as a brush roll.

As shown, a debriding rib 1310 extends along at least a portion of the robotic cleaner dust cup inlet 1302 and is integrally formed from a portion of the robotic cleaner dust cup 1200 (e.g., a portion the dust cup body 1202 or the openable door 1204). The debriding rib 1310 includes one or more debriding teeth 1312 configured to engage an agitator of a robotic cleaner. Engagement between the debriding rib 1310 and the agitator can cause fibrous debris (e.g., hair or string) entangled about the agitator to be removed therefrom. Once removed from the agitator, the fibrous debris can pass through the robotic cleaner dust cup inlet 1302. At least a portion of the fibrous debris passing through the robotic cleaner dust cup inlet 1302 may engage the debris fin 800.

As also shown, the robotic cleaner dust cup 1200 may include a flow directer (or director) 1306 proximate a robotic cleaner dust cup outlet 1308, wherein the robotic cleaner dust cup outlet 1308 and the robotic cleaner dust cup inlet 1302 are on opposing sides of the robotic cleaner dust cup 1200. The flow directer 1306 is configured to urge air incident thereon in a direction away from the openable door 1204. In other words, the flow directer 1306 is configured to urge incident air in a direction of the robotic cleaner dust cup outlet 1308. For example, the flow directer 1306 may include one or more curved and/or angled surfaces on which air is incident, wherein the one or more curved and/or angled surfaces urge incident air in a direction toward the robotic cleaner dust cup outlet 1308. As such, the flow directer 1306 extends into the robotic cleaner dust cup 1200 in a direction away from the openable door 1204.

In some instances, the flow directer 1306 may occlude at least a portion of the robotic cleaner dust cup outlet 1308. As such, the flow directer 1306 may increase a velocity of air flowing through the robotic cleaner dust cup outlet 1308.

Figure 14:
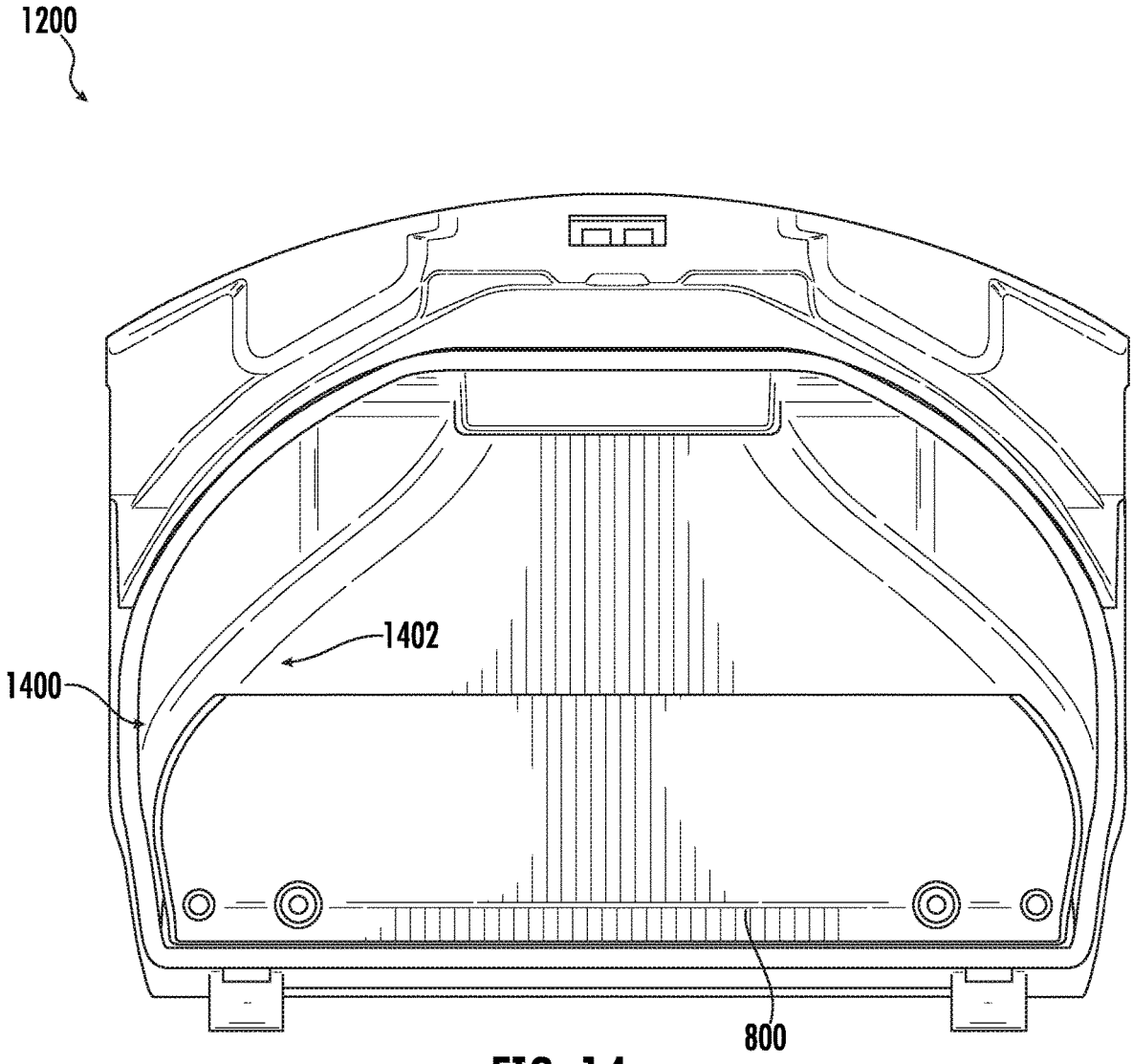
FIG. 14 shows a top view of the dust cup of FIG. 12 having an openable door removed therefrom, consistent with embodiments of the present disclosure.

FIG. 14 shows a top view of the robotic cleaner dust cup 1200 having the openable door 1204 removed therefrom. As shown, the debris fin 800 may have a shape that generally corresponds to an internal shape of the robotic cleaner dust cup 1200. For example, and as shown, opposing longitudinal ends of the debris fin 800 may include curved regions 1400 that correspond to a curvature of a corresponding internal surface 1402 of the robotic cleaner dust cup 1200.

Figure 15:
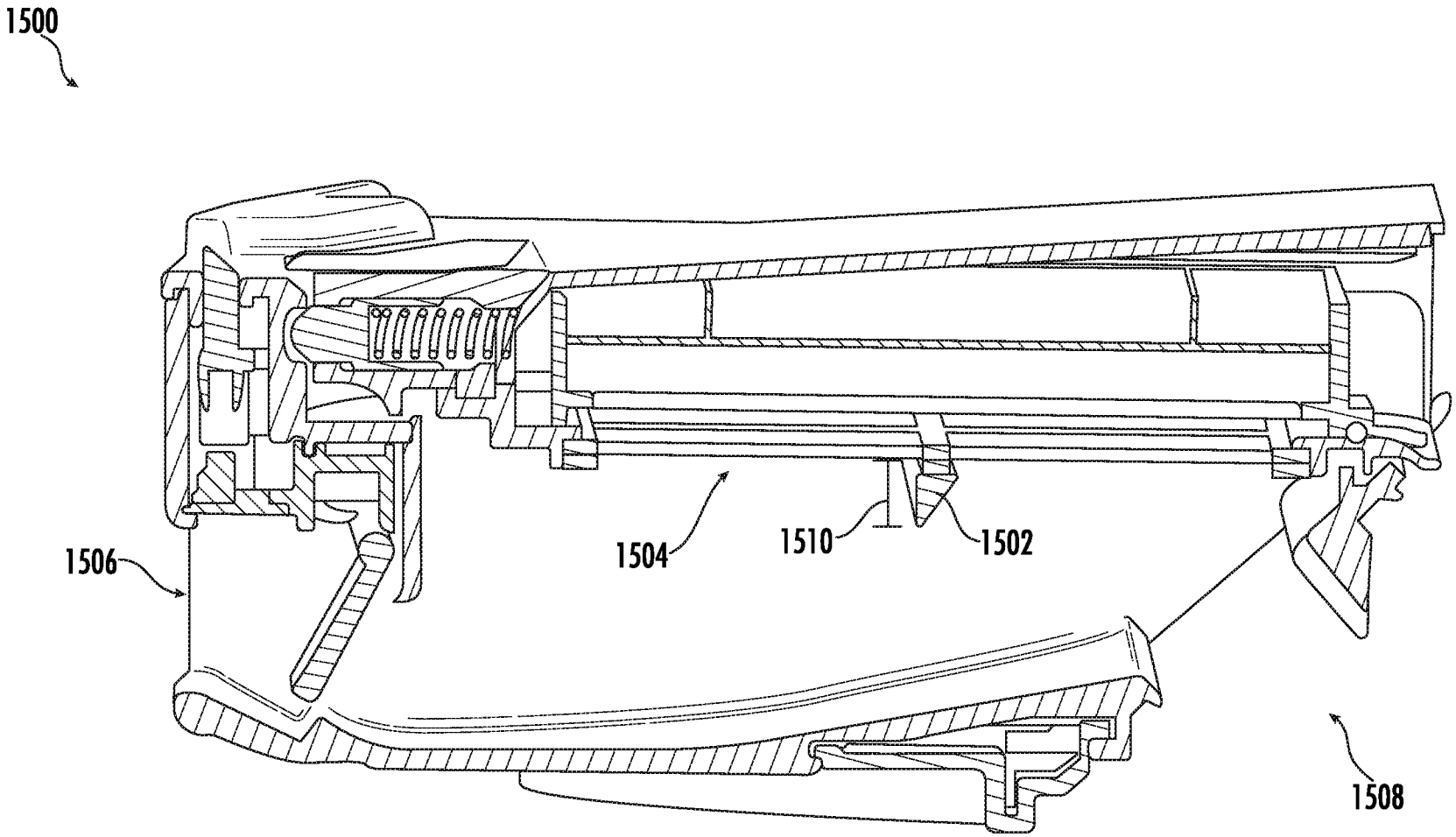
FIG. 15 shows a cross-sectional perspective view of an example of a robotic cleaner dust cup, consistent with embodiments of the present disclosure.

FIG. 15 shows cross-sectional view another example of a robotic cleaner dust cup 1500, which may be an example of the robotic cleaner dust cup 200 of FIG. 2. As shown, the robotic cleaner dust cup 1500 can include a debris fin 1502 (which may be an example of the debris fin 212 of FIG. 2) extending from a top surface 1504 of the robotic cleaner dust cup 1500 at a location between a robotic cleaner dust cup outlet 1506 and a robotic cleaner dust cup inlet 1508. For example, the debris fin 1502 may extend from a central region of the top surface 1504 (e.g., a region corresponding to a middle 10%, 20%, 30%, 40%, and/or 50% of the surface area of the top surface 1504). A measure of an airflow body length 1510 may be in a range of, for example, 5 mm to 10 mm.

Figure 16:
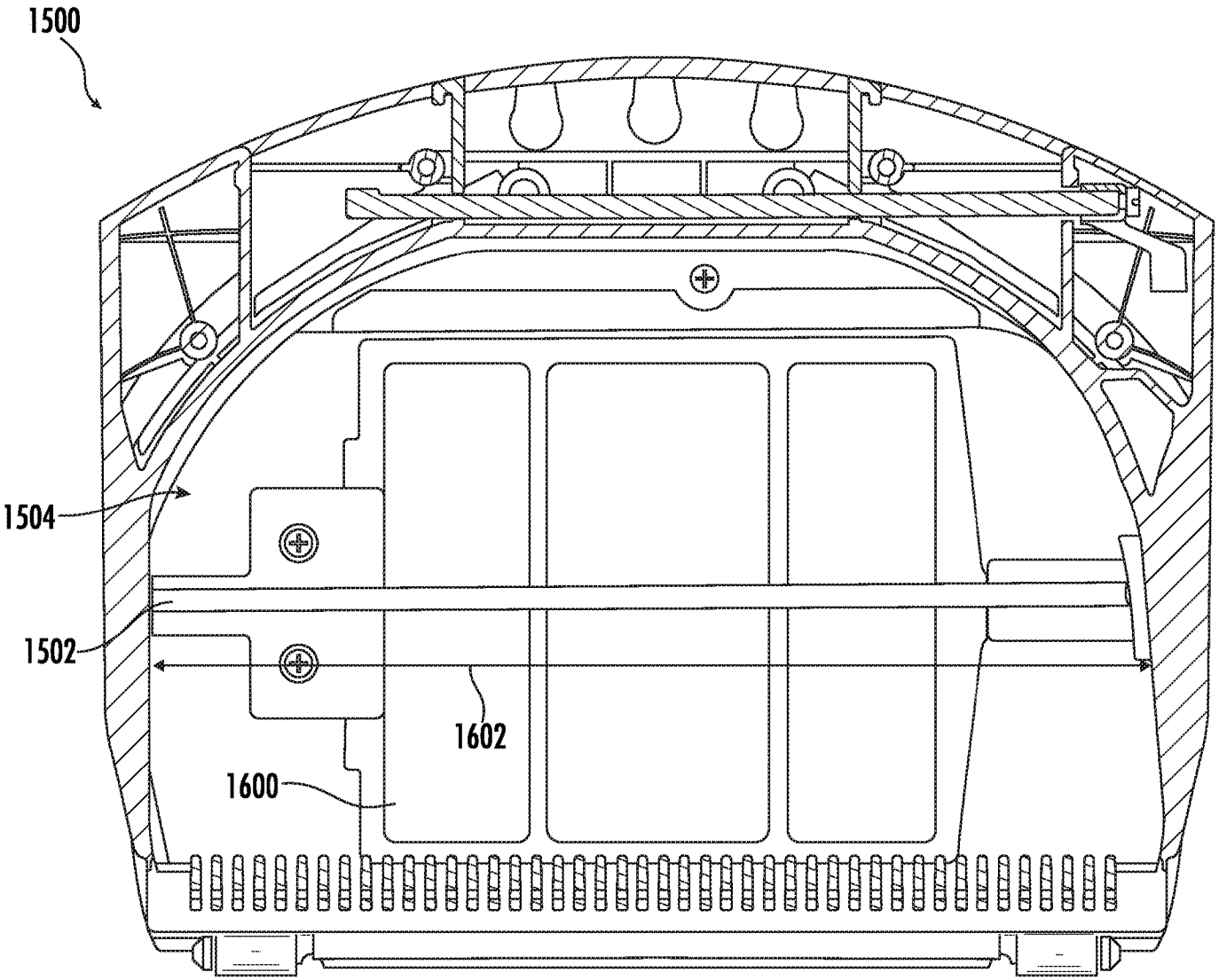
FIG. 16 shows another cross-sectional view of the robotic cleaner dust cup of FIG. 15, consistent with embodiments of the present disclosure.

FIG. 16 shows another cross-sectional view of the robotic cleaner dust cup 1500. As shown, the debris fin 1502 is coupled to the top surface 1504 such that the debris fin 1502 extends across a filter 1600 that defines at least a portion of the top surface 1504. In some instances, the debris fin 1502 may be coupled to and/or extend from the filter 1600 (e.g., coupled to a frame holding the filter 1600).

As shown, the debris fin 1502 may extend across an entire robotic cleaner dust cup cavity width 1602 of the robotic cleaner dust cup 1500. Alternatively, the debris fin 1502 may extend across only a portion of the robotic cleaner dust cup cavity width 1602 of the robotic cleaner dust cup 1500.

Figure 17:
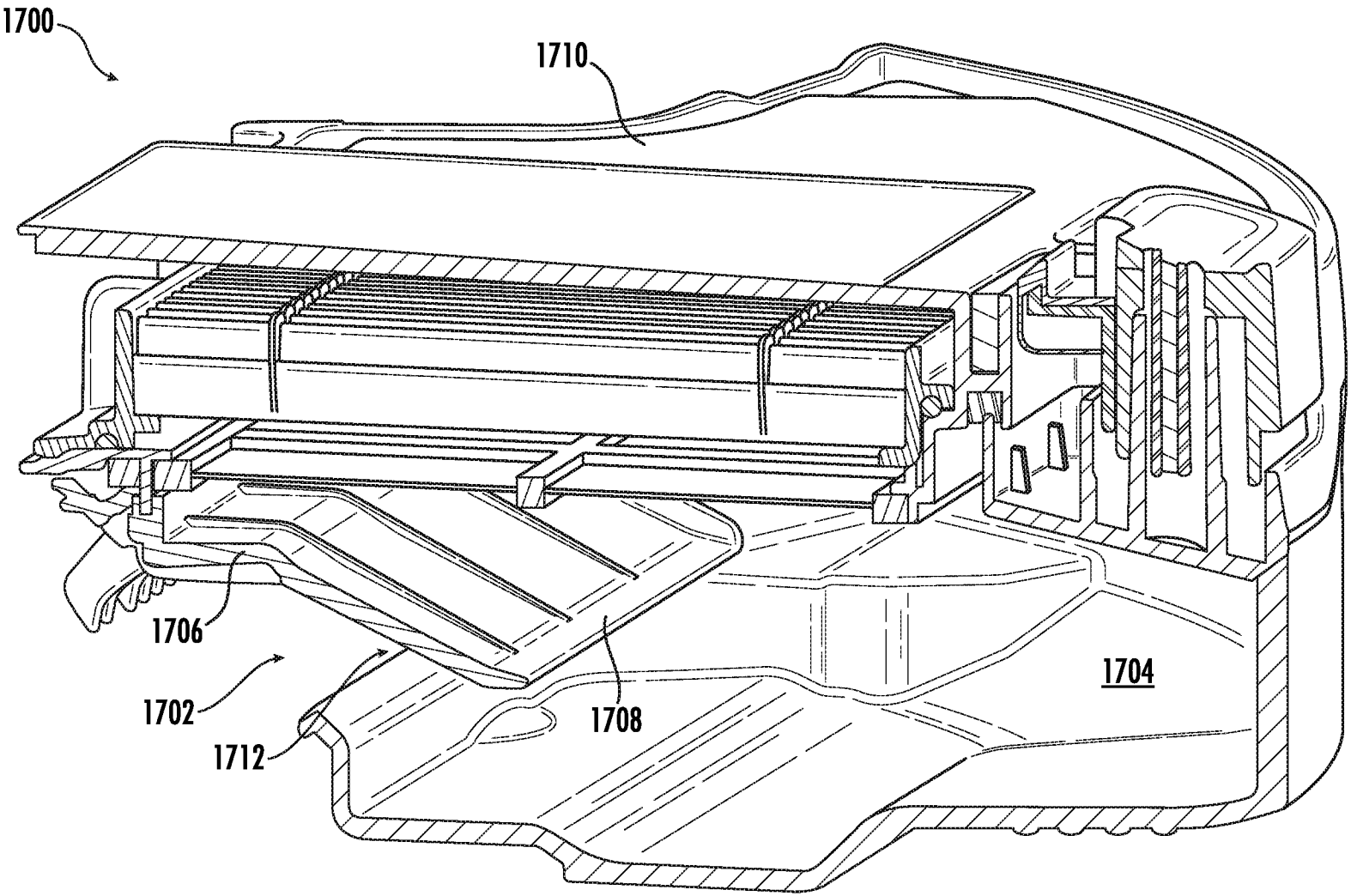
FIG. 17 shows a cross-sectional perspective view of an example of a robotic cleaner dust cup having a debris fin, consistent with embodiments of the present disclosure.

FIG. 17 shows a cross-sectional view of a robotic cleaner dust cup 1700, which may be an example of the robotic cleaner dust cup 200 of FIG. 2, having a debris fin 1702, which may be an example of the debris fin 212 of FIG. 2. As shown, the debris fin 1702 extends within a dust cup cavity 1704 of the robotic cleaner dust cup 1700. The debris fin 1702 includes a fin mount 1706 and an airflow body 1708 extending from the fin mount 1706. The fin mount 1706 is configured to couple the debris fin 1702 to the robotic cleaner dust cup 1700 (e.g., to a top portion of the robotic cleaner dust cup 1700 such as an openable door 1710). The airflow body 1708 defines at least a portion of an airflow surface 1712 of the debris fin 1702. In some instances, the fin mount 1706 may define at least portion of the airflow surface 1712. As such, in some instances, at least a portion of the fin mount 1706 and the airflow body 1708 may generally be described as defining the airflow surface 1712 of the debris fin 1702. The airflow body 1708 can be configured to extend from the fin mount 1706 to encourage a smooth transition in air flowing along the airflow surface 1712 when air transitions from the fin mount 1706 to the airflow body 1708. For example, the fin mount 1706 and the airflow body 1708 may define at least one curved region along the airflow surface 1712.

Figure 18:
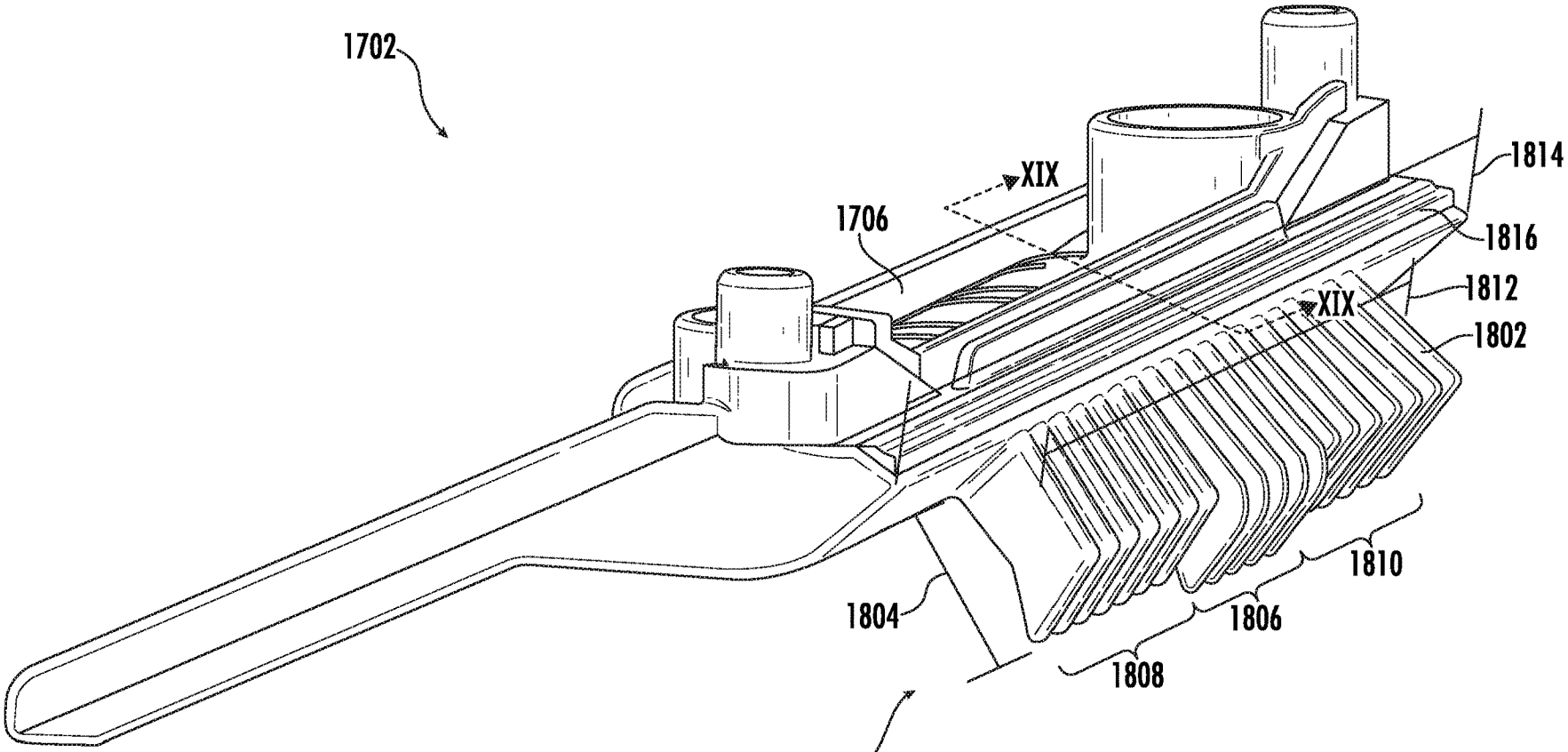
FIG. 18 shows a perspective view of the debris fin of FIG. 17, consistent with embodiments of the present disclosure.

FIG. 18 shows a perspective view of the debris fin 1702. As shown, the debris fin 1702 includes a debriding rib 1800 having one or more debriding teeth 1802 extending therefrom. The debriding teeth 1802 are configured to engage an agitator (e.g., a brush roll) of a robotic cleaner such that at least a portion of fibrous debris (e.g., hair or string) entangled about the agitator can be removed therefrom.

The debriding rib 1800 can be directly coupled to or integrally formed from a portion of the debris fin 1702. As shown, the debriding rib 1800 is integrally formed from the fin mount 1706 such that the debriding teeth 1802 are external to the dust cup cavity 1704. As such, when the agitator of the robotic cleaner is rotated, the debriding teeth 1802 come into engagement with at least a portion of the agitator (e.g., bristles and/or flaps extending from a body of the agitator). When the debriding rib 1800 is coupled to or integrally formed from the debris fin 1702, as opposed to being, for example, directly coupled to the robotic cleaner dust cup 1700 (e.g., to a dust cup body or openable door of the robotic cleaner dust cup 1700), sound generated by operation of the robotic cleaner (e.g., sound generated as a result of the agitator contacting the debriding rib) may be reduced. Additionally, or alternatively, directly coupling the debriding rib 1800 to or integrally forming the debriding rib 1800 from a portion of the debris fin 1702 may reduce the transmission of vibrations to the robotic cleaner dust cup 1700.

In some instances, the debriding teeth 1802 may have a plurality of tooth lengths 1804. For example, the tooth length 1804 for debriding teeth 1802 extending from a central portion 1806 of the debriding rib 1800 may measure greater than the tooth length 1804 for debriding teeth 1802 extending from lateral portions 1808 and 1810 of the debriding rib 1800.

A comb length 1812 of the debriding rib 1800 may measure less than a corresponding debris fin width 1814. The comb length 1812 may generally be described as corresponding to a separation distance between the two distal most debriding teeth 1802 of the debriding rib 1800.

In some instances, a seal 1816 may extend along a portion of the fin mount 1706. The seal 1816 can be positioned such that the seal 1816 extends between the fin mount 1706 and a portion of the robotic cleaner dust cup 1700 when the debris fin 1702 is coupled to the robotic cleaner dust cup 1700. The seal 1816 may reduce sound generated as a result of vibrations in the debris fin 1702 when compared to embodiments without the seal 1816.

Figure 19A:
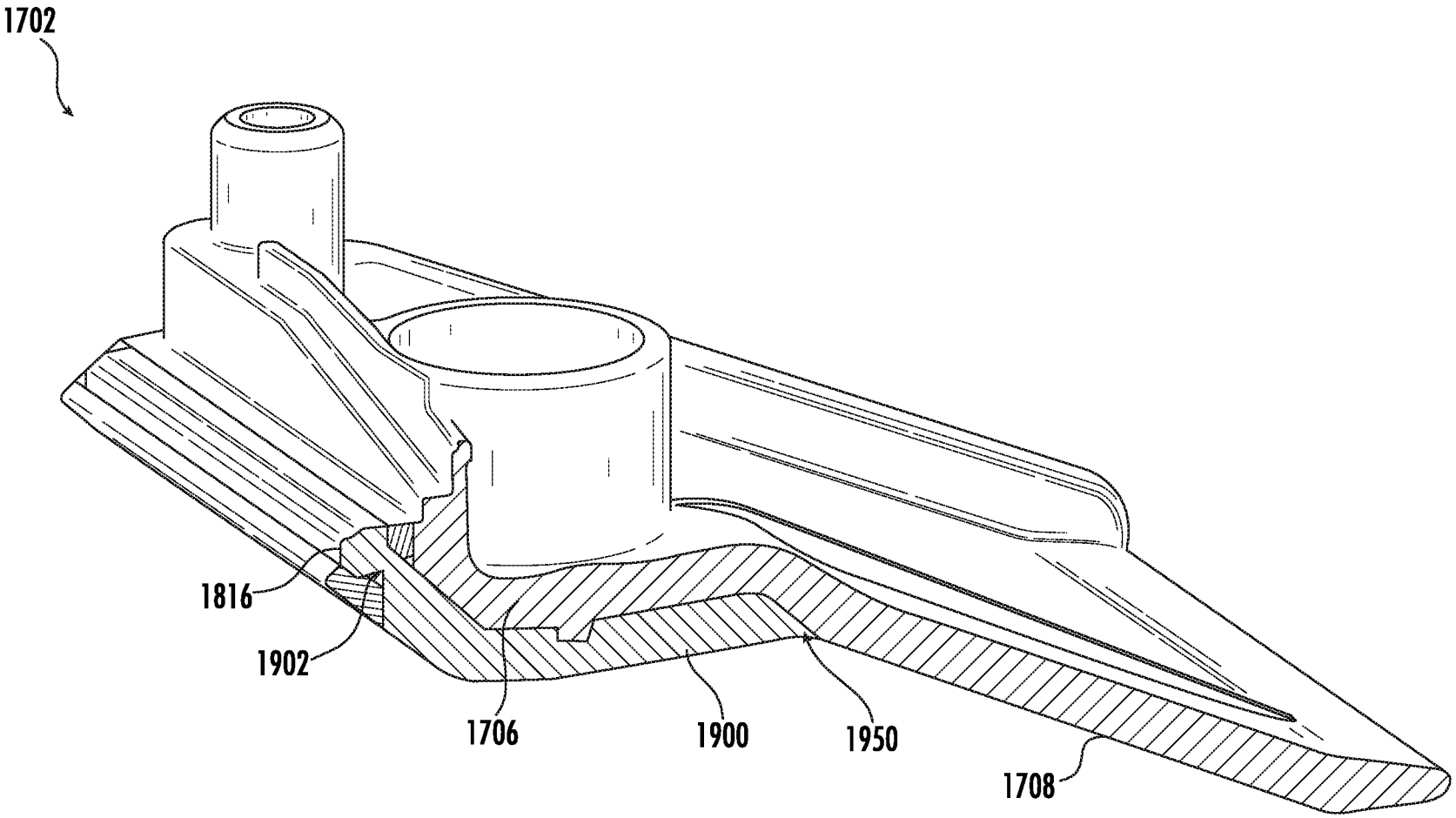
FIG. 19A shows a perspective cross-sectional view of the debris fin of FIG. 17 taken along the line XIX-XIX of FIG. 18, consistent with embodiments of the present disclosure.

FIG. 19A shows a perspective cross-sectional view of the debris fin 1702 taken along the line XIX-XIX of FIG. 18. The debris fin 1702 can include an overlay 1900 that extends along at least a portion of the fin mount 1706 and/or at least a portion of the airflow body 1708 (e.g., extend along at least portion of the fin mount 1706 only, at least a portion of the airflow body 1708 only, or at least a portion of both the fin mount 1706 and the airflow body 1708). The overlay 1900 can be configured such that air flowing along the debris fin 1702 extends along at least a portion of the overlay 1900. For example, debris entrained within air flowing along the debris fin 1702 may be incident on a portion of the overlay 1900. As such, the overlay 1900 can be configured to absorb at least a portion of the kinetic energy in debris incident thereon. This may reduce an intensity of sound generated by debris impacting the debris fin 1702 (e.g., increasing a compliance of the overlay 1900 may reduce sound generation). For example, the overlay 1900 may be an elastic material such as a rubber, a silicone, a thermoplastic polyurethane (TPU), and/or any other elastic material. By way of further example, the overlay 1900 may be a thermoplastic polyurethane having a Shore 40A hardness. A mass of the overlay 1900 may also reduce an intensity of sound generated by debris impacting the debris fin 1702 and/or by vibrations induced in the debris fin 1702 by air flowing thereover. For example, as a mass of the overlay 1900 is increased, an overall amount of sound generated by debris impacting the debris fin 1702 and/or by vibrations induced in the debris fin 1702 by air flowing thereover may be reduced. Accordingly, the overlay 1900 may generally be described as being configured to provide acoustic and/or vibration dampening.

The overlay 1900 may be coupled to the debris fin 1702 using one or more of adhesives, mechanical couplings (e.g., screws, press-fits, snap-fits, and/or any other type of mechanical coupling), and/or any other form of coupling. For example, in some instances, the overlay 1900 is overmolded over at least a portion of the debris fin 1702. In these instances, the debris fin 1702 may include one or more openings (e.g., overlay passthroughs) 1902 (see, also, FIG. 19B) through which a portion of the overlay 1900 may extend. For example, and as shown, the overlay 1900 may extend through at least one of the one or more openings 1902 such that the overlay 1900 defines at least a portion of the seal 1816. Additionally, or alternatively, at least one of the one or more openings 1902 may be configured to couple the overlay 1900 to the debris fin 1702 (e.g., at the fin mount 1706 and/or the airflow body 1708) by forming part of, for example, a mechanical interlock between the overlay 1900 and the one or more openings 1902. In some instances, the overlay 1900 may be disposed within an overlay receptacle 1950 (see, also, FIG. 19B) defined within one or more of the fin mount 1706 and/or the airflow body 1708.

Figure 19B:
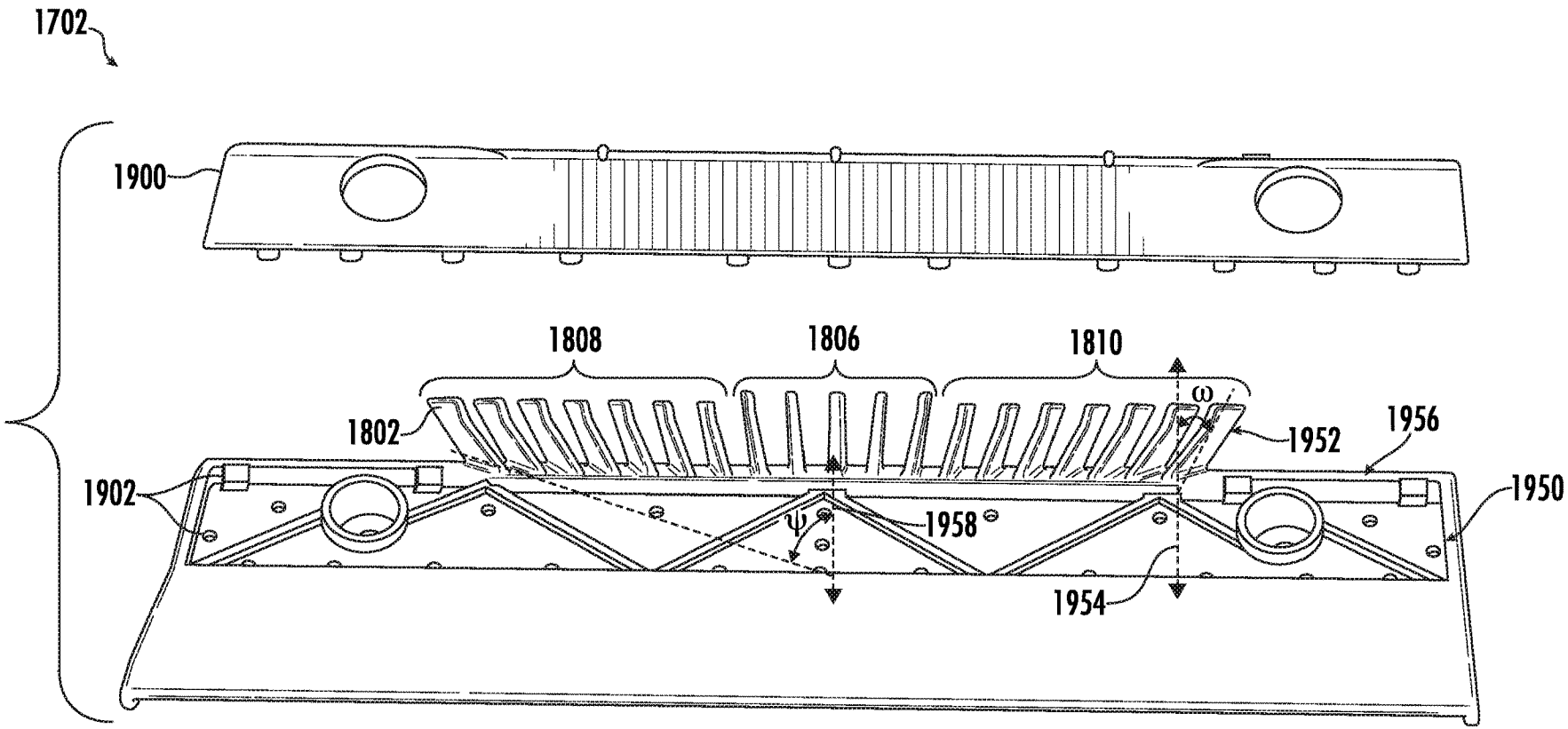
FIG. 19B shows a perspective exploded view of the debris fin of FIG. 17, consistent with embodiments of the present disclosure.

As shown in FIG. 19B, the debriding teeth 1802 within the lateral portions 1808 and 1810 may be angled relative to the debriding teeth 1802 within the central portion 1806. In some instances, the debriding teeth 1802 in each of the lateral portions 1808 and 1810 may include a side angle ω and a twist angle ψ. The side angle ω may be measured between a planar side surface 1952 of a respective debriding tooth 1802 and a tooth root axis 1954 that extends perpendicular to a surface 1956 from which the respective debriding tooth 1802 extends. The twist angle ψ may be measured between the planar side surface 1952 of a respective debriding tooth 1802 and a center tooth axis 1958 that extends generally parallel to a corresponding planar side surface 1952 of the center most debriding tooth 1802 within the central portion 1806. For example, the side angle ω may be configured such that the debriding teeth 1802 of the lateral portions 1808 and 1810 diverge from the central portion 1806 with increasing distance from the surface 1956 and the twist angle ψ may be configured such that the debriding teeth 1802 of the lateral portions 1808 and 1810 converge towards the central portion 1806 (e.g., in a direction of the agitator).

Figure 20:
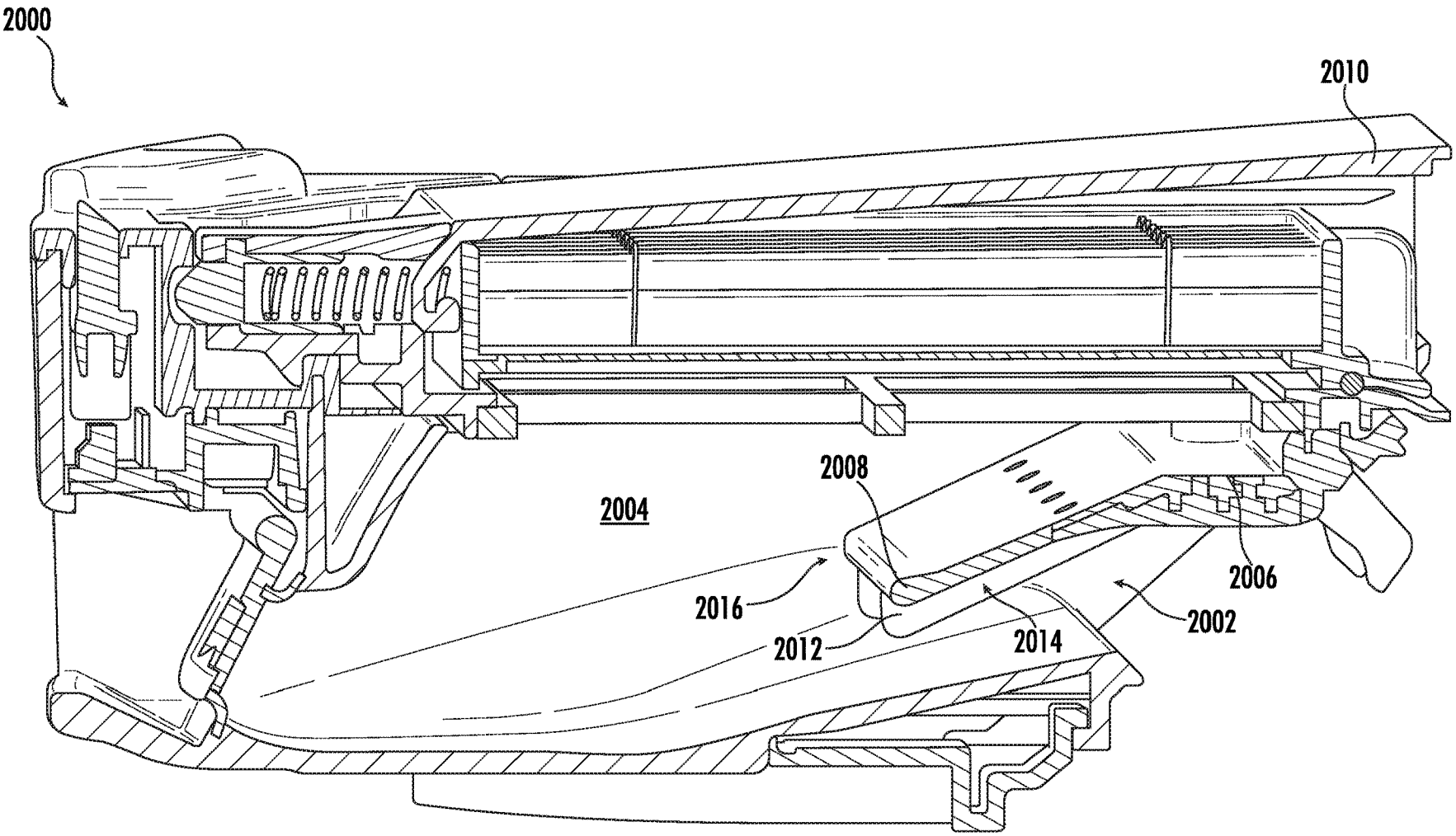
FIG. 20 shows a cross-sectional perspective view of an example of a robotic cleaner dust cup having a debris fin, consistent with embodiments of the present disclosure.

FIG. 20 shows a cross-sectional view of a robotic cleaner dust cup 2000, which may be an example of the robotic cleaner dust cup 200 of FIG. 2, having a debris fin 2002, which may be an example of the debris fin 212 of FIG. 2. As shown, the debris fin 2002 extends within a dust cup cavity 2004 of the robotic cleaner dust cup 2000. The debris fin 2002 includes a fin mount 2006 and an airflow body 2008 extending from the fin mount 2006. The fin mount 2006 is configured to couple the debris fin 2002 to the robotic cleaner dust cup 2000 (e.g., to a top portion of the robotic cleaner dust cup 2000 such as an openable door 2010). The airflow body 2008 defines at least a portion of an airflow surface 2014 of the debris fin 2002. In some instances, the fin mount 2006 may define at least portion of the airflow surface 2014. As such, in some instances, at least a portion of the fin mount 2006 and the airflow body 2008 may generally be described as defining the airflow surface 2014 of the debris fin 2002. The airflow body 2008 can be configured to extend from the fin mount 2006 to encourage a smooth transition in air flowing along the airflow surface 2014 when air transitions from the fin mount 2006 to the airflow body 2008. For example, the fin mount 2006 and the airflow body 2008 may define at least one curved region along the airflow surface 2014.

As shown, the debris fin 2002 can include one or more ribs 2012 extending thereon. The ribs 2012 may extend from one or more of the fin mount 2006 and/or the airflow body 2008. For example, the one or more ribs 2012 may extend continuously from a trailing edge 2016 of the airflow body 2008 and along at least a portion of the fin mount 2006.

Figure 21:
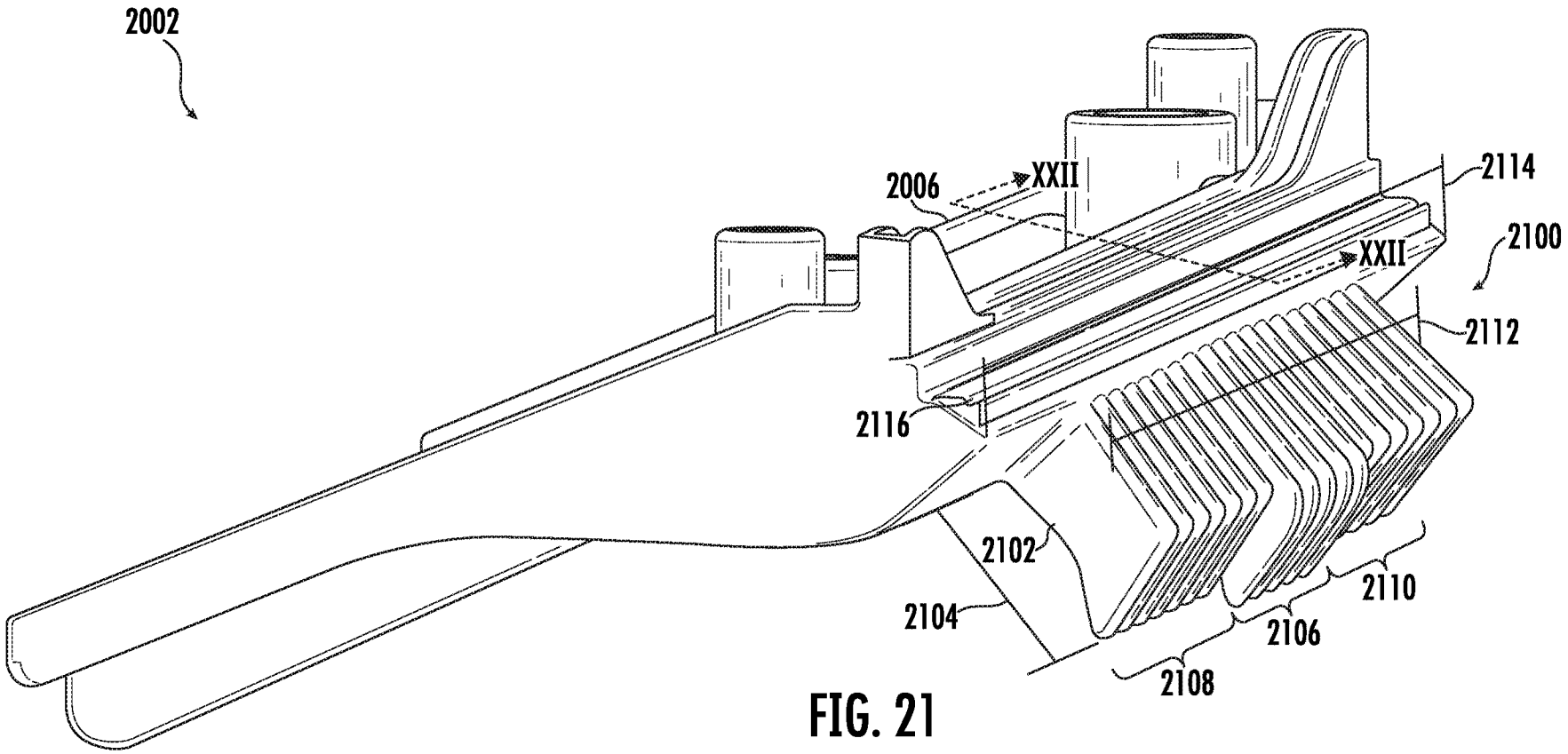
FIG. 21 shows a perspective view of the debris fin of FIG. 20, consistent with embodiments of the present disclosure.

FIG. 21 shows a perspective view of the debris fin 2002. As shown, the debris fin 2002 includes a debriding rib 2100 having one or more debriding teeth 2102 extending therefrom. The debriding teeth 2102 are configured to engage an agitator (e.g., a brush roll) of a robotic cleaner such that at least a portion of fibrous debris (e.g., hair or string) entangled about the agitator can be removed therefrom.

The debriding rib 2100 can be directly coupled to or integrally formed from a portion of the debris fin 2002. As shown, the debriding rib 2100 is integrally formed from the fin mount 2006 such that the debriding teeth 2102 are external to the dust cup cavity 2004. As such, when the agitator of the robotic cleaner is rotated, the debriding teeth 2102 come into engagement with at least a portion of the agitator (e.g., bristles and/or flaps extending from a body of the agitator). When the debriding rib 2100 is coupled to or integrally formed from the debris fin 2002, as opposed to being, for example, directly coupled to the robotic cleaner dust cup 2000 (e.g., to a dust cup body or openable door of the robotic cleaner dust cup 2000), sound generated by operation of the robotic cleaner (e.g., sound generated as a result of the agitator contacting the debriding rib) may be reduced. Additionally, or alternatively, directly coupling the debriding rib 2100 to or integrally forming the debriding rib 2100 from a portion of the debris fin 2002 may reduce the transmission of vibrations to the robotic cleaner dust cup 2000.

In some instances, the debriding teeth 2102 may have a plurality of tooth lengths 2104. For example, the tooth length 2104 for debriding teeth 2102 extending from a central portion 2106 of the debriding rib 2100 may measure greater than the tooth length 2104 for debriding teeth 2102 extending from lateral portions 2108 and 2110 of the debriding rib 2100.

A comb length 2112 of the debriding rib 2100 may measure less than a corresponding debris fin width 2114. The comb length 2112 may generally be described as corresponding to a separation distance between the two distal most debriding teeth 2102 of the debriding rib 2100.

In some instances, a seal 2116 may extend along a portion of the fin mount 2006. The seal 2116 can be positioned such that the seal 2116 extends between the fin mount 2006 and a portion of the robotic cleaner dust cup 2000 when the debris fin 2002 is coupled to the robotic cleaner dust cup 2000. The seal 2116 may reduce sound generated as a result of vibrations in the debris fin 2002 when compared to embodiments without the seal 2116.

Figure 22:
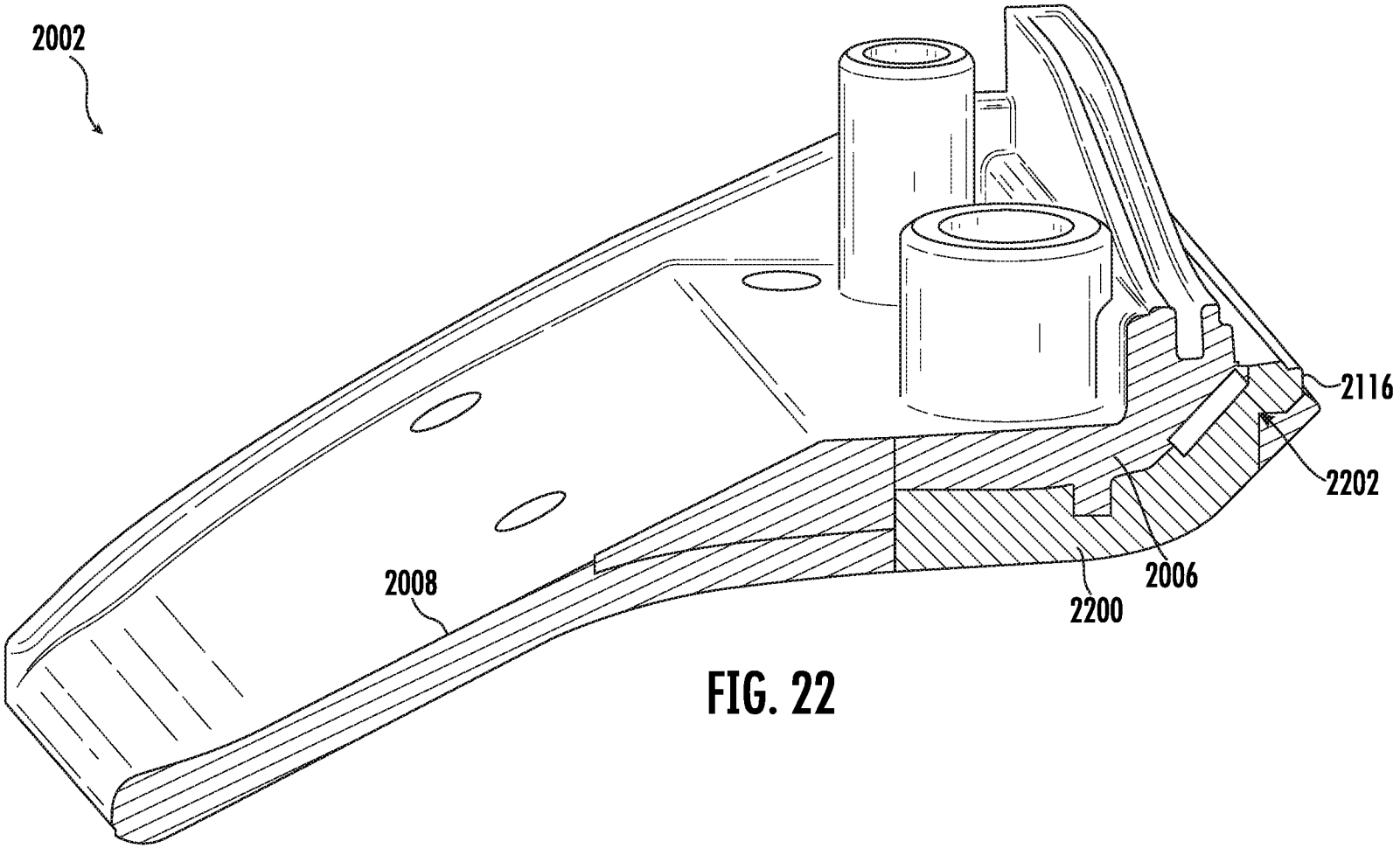
FIG. 22 shows a perspective cross-sectional view of the debris fin of FIG. 20 taken along the line XXII-XXII of FIG. 21, consistent with embodiments of the present disclosure.

FIG. 22 shows a perspective cross-sectional view of the debris fin 2002 taken along the line XXII-XXII of FIG. 21. The debris fin 2002 can include an overlay 2200 that extends along at least a portion of the fin mount 2006 and/or at least a portion of the airflow body 2008 (e.g., extend along at least portion of the fin mount 2006 only, at least a portion of the airflow body 2008 only, or at least a portion of both the fin mount 2006 and the airflow body 2008). The overlay 2200 can be configured such that air flowing along the debris fin 2002 extends along at least a portion of the overlay 2200. For example, debris entrained within air flowing along the debris fin 2002 may be incident on a portion of the overlay 2200. As such, the overlay 2200 can be configured to absorb at least a portion of the kinetic energy in debris incident thereon. This may reduce an intensity of sound generated by debris impacting the debris fin 2002 (e.g., increasing a compliance of the overlay 2200 may reduce sound generation). For example, the overlay 2200 may be an elastic material such as a rubber, a silicone, a thermoplastic polyurethane (TPU), and/or any other elastic material. By way of further example, the overlay 2200 may be a thermoplastic polyurethane having a Shore 40A hardness. A mass of the overlay 2200 may also reduce an intensity of sound generated by debris impacting the debris fin 2002 and/or by vibrations induced in the debris fin 1702 by air flowing thereover. For example, as a mass of the overlay 2200 is increased, an overall amount of sound generated by debris impacting the debris fin 2002 and/or by vibrations induced in the debris fin 1702 by air flowing thereover may be reduced. Accordingly, the overlay 2200 may generally be described as being configured to provide acoustic and/or vibration dampening.

The overlay 2200 may be coupled to the debris fin 2002 using one or more of adhesives, mechanical couplings (e.g., screws, press-fits, snap-fits, and/or any other type of mechanical coupling), and/or any other form of coupling. For example, in some instances, the overlay 2200 is overmolded over at least a portion of the debris fin 2002. In these instances, the debris fin 2002 may include one or more openings 2202 (see, also, FIG. 23) through which a portion of the overlay 2200 may extend. For example, and as shown, the overlay 2200 may extend through at least one of the one or more openings (e.g., overlay passthroughs) 2202 such that the overlay 2200 defines at least a portion of the seal 2116. Additionally, or alternatively, at least one of the one or more openings 2202 may be configured to couple the overlay 2200 to the debris fin 2002 (e.g., at the fin mount 2006 and/or the airflow body 2008) by forming part of, for example, a mechanical interlock between the overlay 2200 and the one or more openings 2202.

Figure 23:
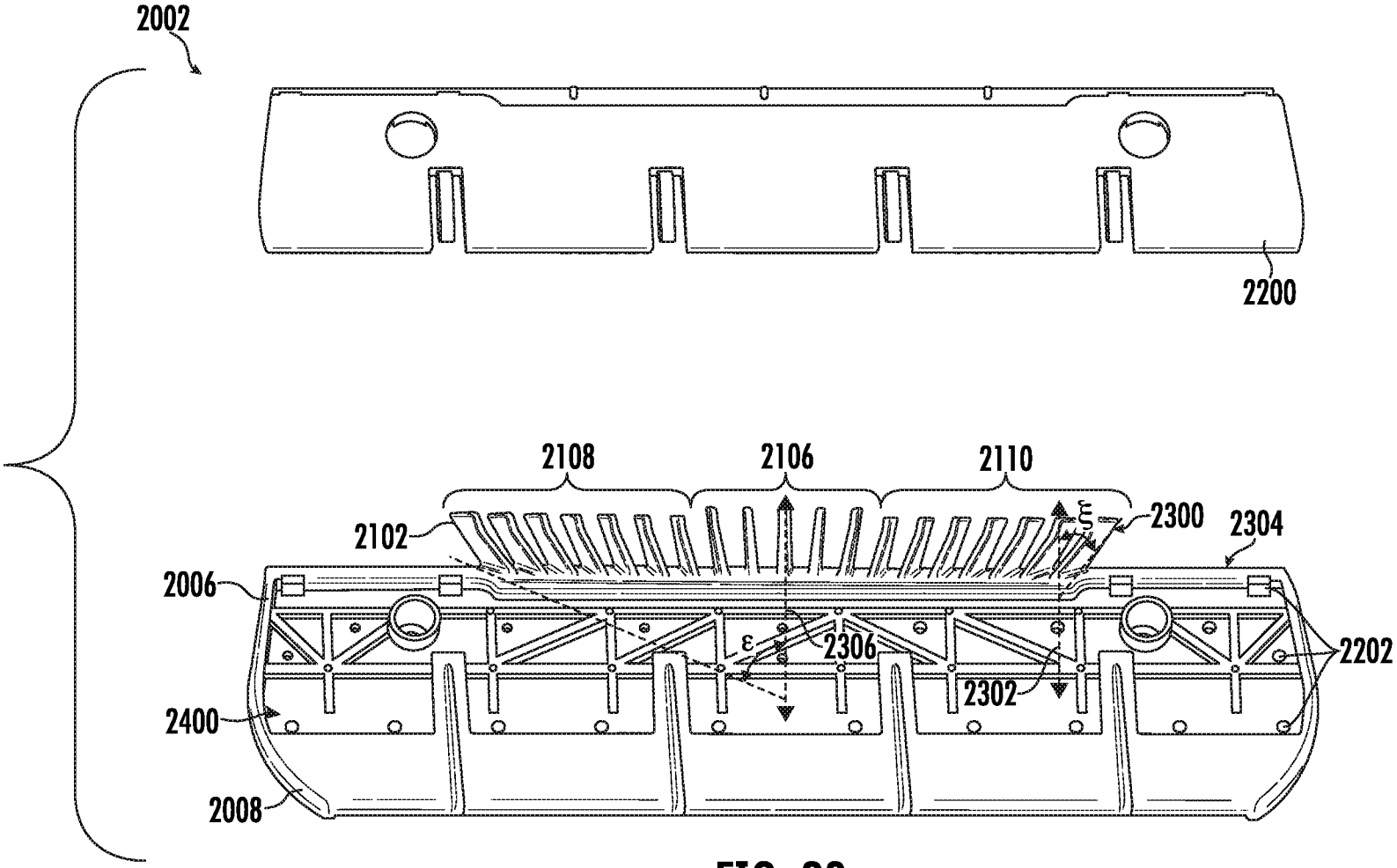
FIG. 23 shows a perspective exploded view of the debris fin of FIG. 20, consistent with embodiments of the present disclosure.

As also shown in FIG. 23, the debriding teeth 2102 within the lateral portions 2108 and 2110 may be angled relative to the debriding teeth 2102 within the central portion 2106. In some instances, the debriding teeth 2102 in each of the lateral portions 2108 and 2110 may include a side angle $\xi$ and a twist angle $\varepsilon$. The side angle may be measured between a planar side surface 2300 of a respective debriding tooth 2102 and a tooth root axis 2302 that extends perpendicular to a surface 2304 from which the respective debriding tooth 2102 extends. The twist angle $\varepsilon$ may be measured between the planar side surface 2300 of a respective debriding tooth 2102 and a center tooth axis 2306 that extends generally parallel to a corresponding planar side surface 2300 of the center most debriding tooth 2102 within the central portion 2106. For example, the side angle $\xi$ may be configured such that the debriding teeth 2102 of the lateral portions 2108 and 2110 diverge from the central portion 2106 with increasing distance from the surface 2304 and the twist angle $\varepsilon$ may be configured such that the debriding teeth 2102 of the lateral portions 2108 and 2110 converge towards the central portion 2106 in a direction of the agitator.

Figure 24:
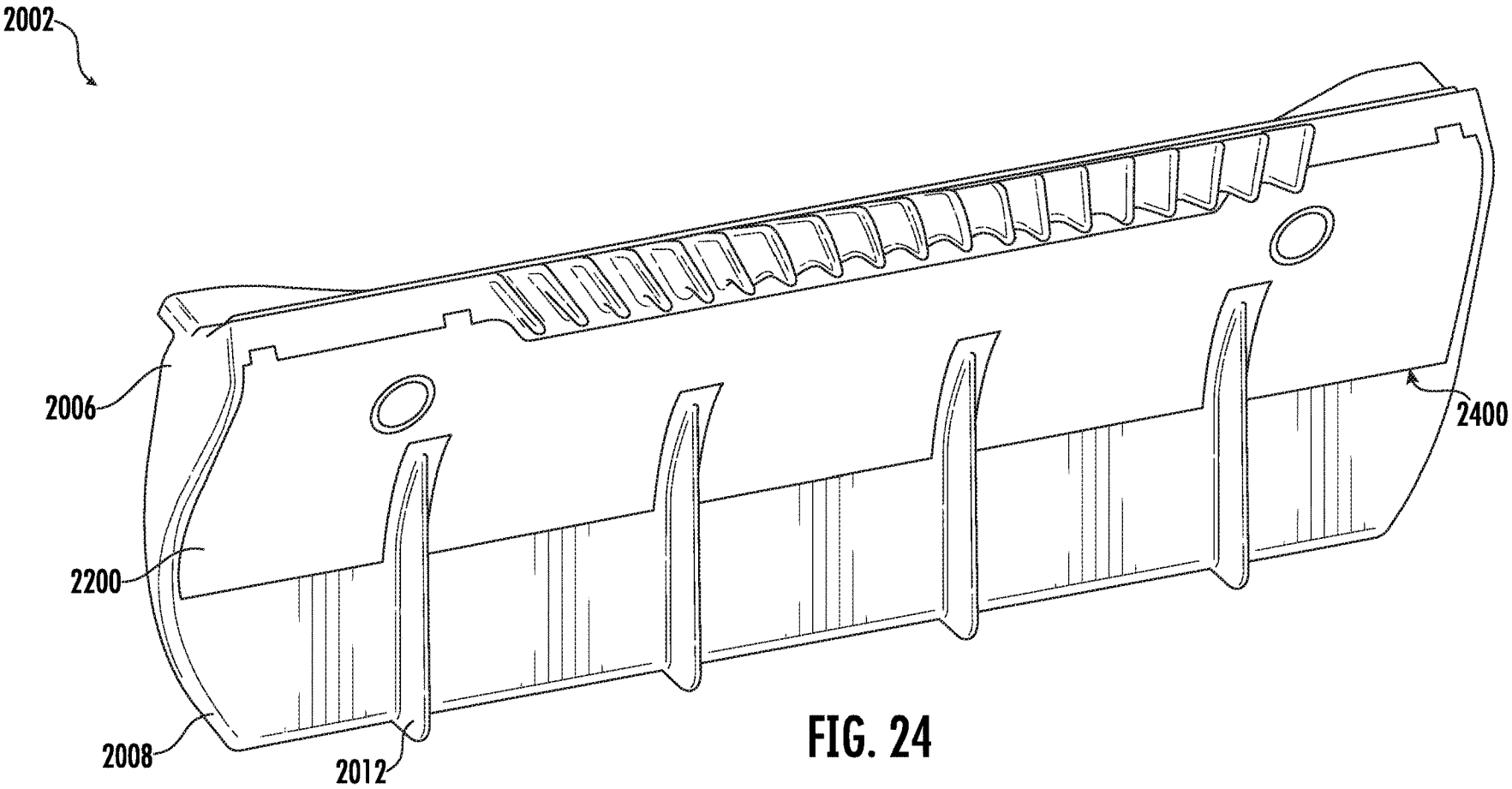
FIG. 24 shows a perspective view of the debris fin of FIG. 20, consistent with embodiments of the present disclosure.

FIG. 24 shows a perspective view of the debris fin 2002. As shown, the overlay 2200 extends along at least a portion of the fin mount 2006 and the airflow body 2008. The overlay 2200 is configured to extend at least partially around the ribs 2012. In some instances, the overlay 2200 may be disposed within an overlay receptacle 2400 (see, also, FIG. 23) defined within one or more of the fin mount 2006 and/or the airflow body 2008.

Figure 26:
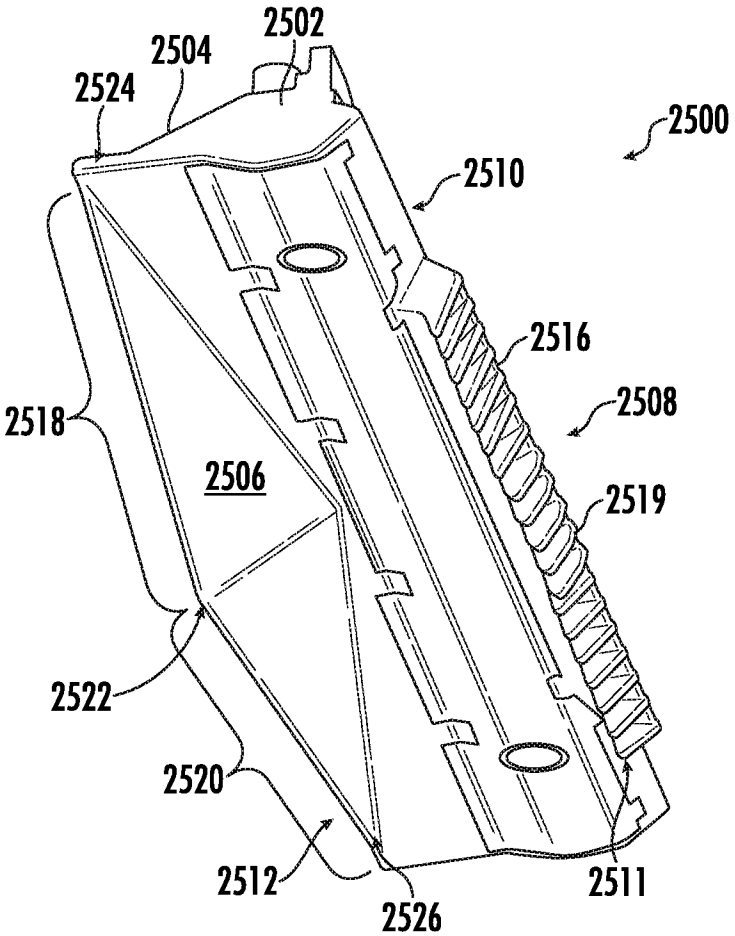
FIG. 26 shows a bottom perspective view of the debris fin of FIG. 25, consistent with embodiments of the present disclosure.
Figure 25:
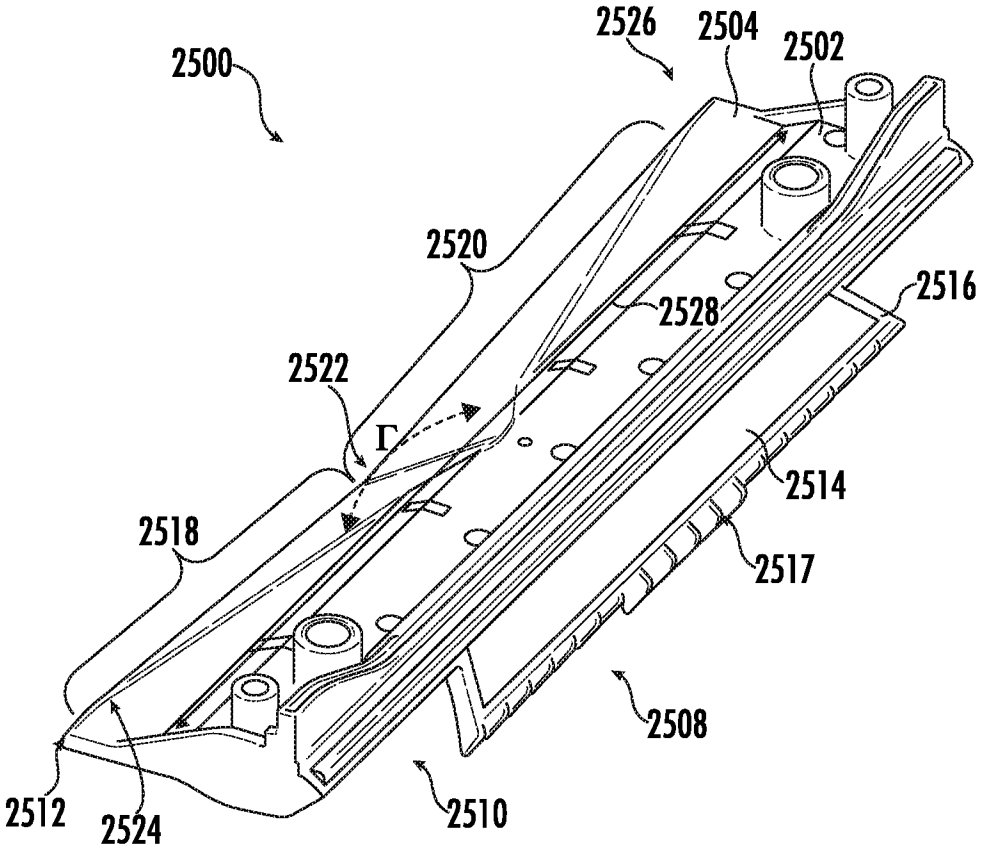
FIG. 25 shows a top perspective view of an example of debris fin, consistent with embodiments of the present disclosure.

FIG. 25 shows a top perspective view of a debris fin 2500 and FIG. 26 shows a bottom perspective view of the debris fin 2500, wherein the debris fin 2500 may be an example of the debris fin 212 of FIG. 2. As shown, the debris fin 2500 includes a fin mount 2502 and an airflow body 2504 extending from the fin mount 2502. The debris fin 2500 defines an airflow surface 2506 that extends along at least a portion of the airflow body 2504 and/or the fin mount 2502. Air entering a dust cup within which the debris fin 2500 extends is incident on and flows along the airflow surface 2506.

As shown, the debris fin 2500 may further include a debriding rib 2508. The debriding rib 2508 extends along at least a portion of the debris fin 2500. For example, the debriding rib 2508 can extend along a leading edge 2510 of the debris fin 2500 such that an engagement region 2511 of the debriding rib 2508 engages (e.g., contacts) an agitator. The leading edge 2510 is opposite a trailing edge 2512 and is positioned closer to an inlet of a dust cup within which the debris fin 2500 extends than the trailing edge 2512. The debriding rib 2508 can further include a platform 2516 that extends along the debriding rib 2508 and that is spaced apart from the engagement region 2511 of the debriding rib 2508. For example, the platform 2516 may extend along at least a portion of a debriding rib top surface 2517 of the debriding rib 2508, wherein the debriding rib top surface 2517 faces a top of a dust cup within which the debris fin 2500 extends. As shown, the platform 2516 may be coupled to teeth 2519 (or debriding teeth) of the debriding rib 2508. Such a configuration may mitigate vibrations induced in the teeth 2519 and/or sound generated as a result of the engagement between the teeth 2519 and the agitator. In other words, the platform 2516 may generally be described as providing sound and/or vibration dampening. Additionally, or alternatively, the platform 2516 may reduce a quantity of debris that becomes trapped between the teeth 2519 of the debriding rib 2508.

An overlay 2514 may extend along at least a portion of the airflow surface 2506. The overlay 2514 can be configured to provide sound and/or vibration dampening. In some instances, a portion of the overlay 2514 may extend along the platform 2516 of the debriding rib 2508. For example, the platform 2516 may define a receptacle for receiving at least a portion of the overlay 2514. By way of further example, the overlay 2514 may define the platform 2516. In this example, the overlay 2514 may directly contact the teeth 2519 of the debriding rib 2508. In some instances, the overlay 2514 may be a single piece or a multiple piece structure. For example, the overlay 2514 may be overmolded over at least a portion of the debris fin 2500.

As shown, the airflow body 2504 includes a first planar region 2518 and a second planar region 2520. The first planar region 2518 extends toward the second planar region 2520, wherein the first and second planar regions 2518 and 2520 intersect at vertex 2522. The vertex 2522 is vertically and horizontally spaced apart from respective distal ends 2524 and 2526 of the first and second planar regions 2518 and 2520. As such, the first and second planar regions 2518 and 2520 define an intersection angle $\Gamma$. The intersection angle $\Gamma$ may measure, for example, in a range of 100° to 170°. By way of further example, the intersection angle $\Gamma$ may measure in a range of 130° to 175°. The vertex 2522 may be centrally positioned along a longitudinal length 2528 of the debris fin 2500.

The planar regions 2518 and 2520 may have a generally triangular shape, wherein an apex of each triangle is defined at the distal ends 2524 and 2526 and a base of the triangle is defined at the vertex 2522. However, the planar regions 2518 and 2520 may have any shape. For example, the planar regions 2518 and 2520 may have a rectangular shape, a trapezoidal shape, or any other shape.

Figure 27:
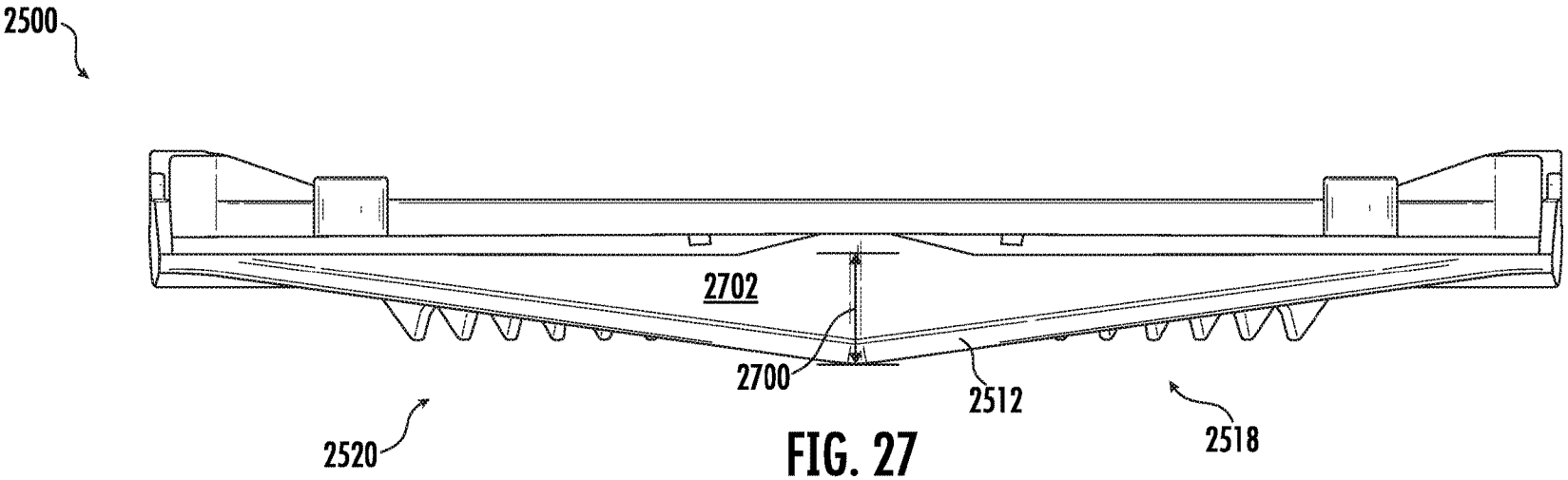
FIG. 27 shows a side view of the debris fin of FIG. 25, consistent with embodiments of the present disclosure.

FIG. 27 shows a side view of the debris fin 2500, wherein the trailing edge 2512 is shown. As shown, the first and second planar regions 2518 and 2520 define a chevron shape (or a triangular wave shape) that extends along at least a portion of the trailing edge 2512. As also shown, a chevron depth 2700 of the chevron shape decreases with increasing distance from the trailing edge 2512. As such, the chevron depth 2700 measures greatest at the trailing edge 2512. A chevron shape may minimize the occlusion, by the debris fin 2500, of an inlet to a dust cup within which the debris fin 2500 extends while still allowing the debris fin 2500 to encourage a straightening of fibrous debris entrained within air incident thereon. Minimizing the occlusion of the inlet may encourage increased airflow into the dust cup and/or encourage easier movement of debris into the dust cup (e.g., reduce a risk of clogging the inlet of the dust cup). Such a configuration may further allow debris to accumulate on a dust cup top facing surface 2702 of the debris fin 2500, which may improve a storage capacity of the dust cup. The dust cup top facing surface 2702 is opposite the airflow surface 2506.

Figure 28:
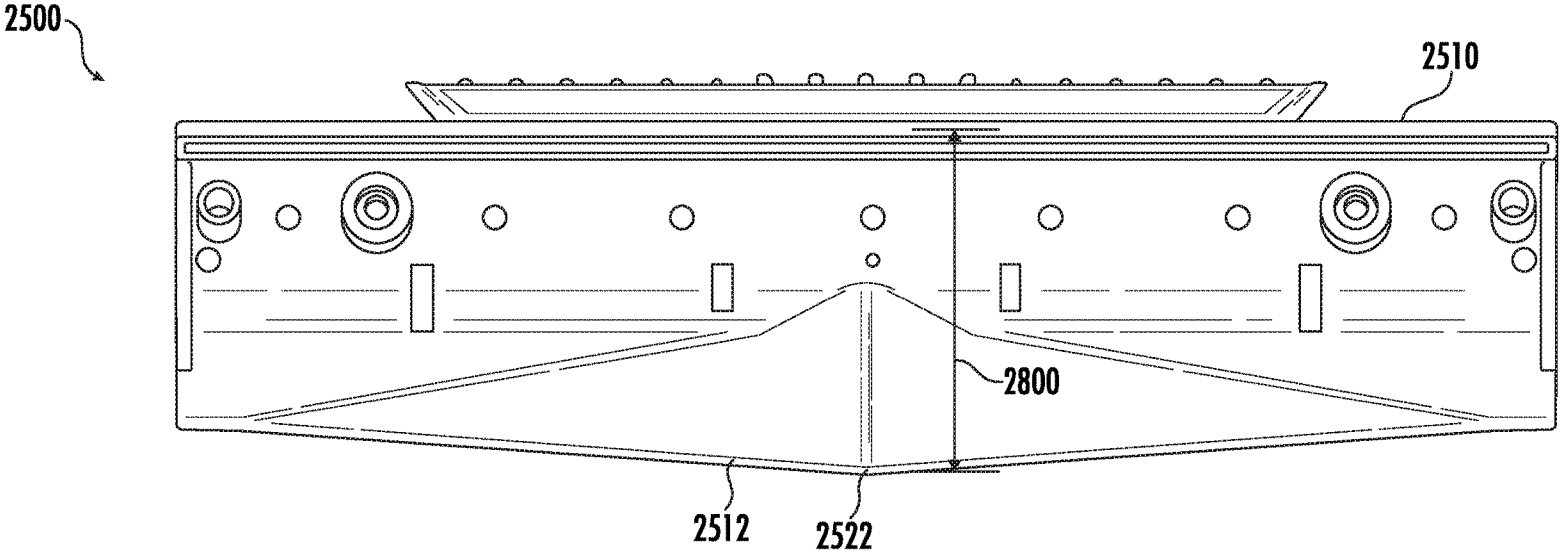
FIG. 28 shows a top view of the debris fin of FIG. 25, consistent with embodiments of the present disclosure.

FIG. 28 shows a top view of the debris fin 2500. As shown, a separation distance 2800 extending between the trailing edge 2512 and the leading edge 2510 increases as the trailing edge 2512 approaches the vertex 2522.

Figure 29:
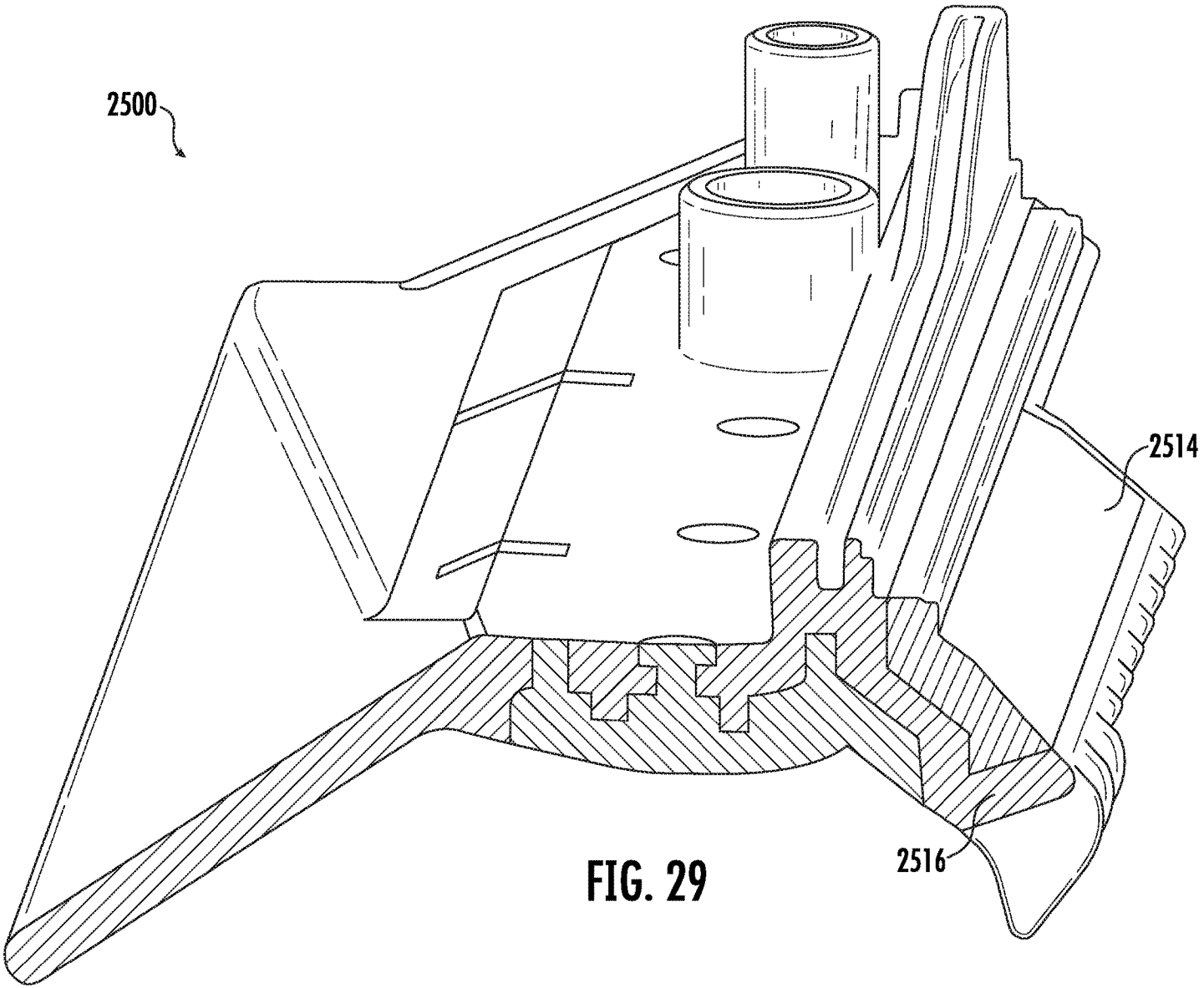
FIG. 29 shows a cross-sectional perspective view of the debris fin of FIG. 25, consistent with embodiments of the present disclosure.

FIG. 29 shows a cross-sectional perspective end view of the debris fin 2500. As shown, the platform 2516 extends along the debriding rib 2508. The platform 2516 is configured such that the overlay 2514 can extend thereon. The overlay 2514 may be configured to increase a mass of the platform 2516, providing sound and/or vibration dampening.

Figure 30:
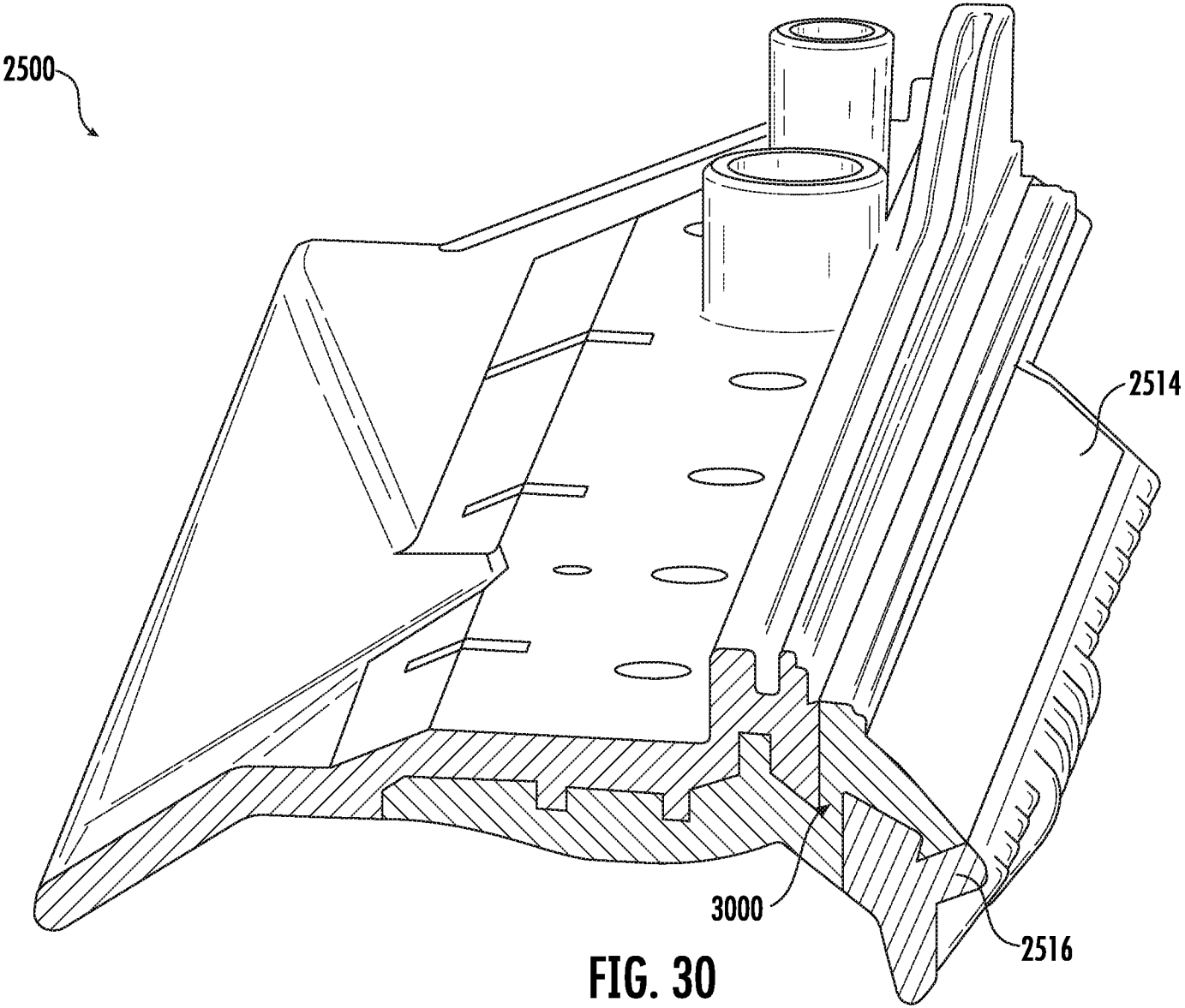
FIG. 30 shows another cross-sectional perspective view of the debris fin of FIG. 25, consistent with embodiments of the present disclosure.

FIG. 30 shows a cross-sectional perspective view of the debris fin 2500. As shown, the overlay 2514 is a single piece structure wherein a first portion of the overlay 2514 extends along the airflow surface 2506 and a second portion of the overlay 2514 extends along the platform 2516. As such, the debris fin 2500 may include one or more overlay pass-throughs 3000 through which a portion of the overlay 2514 extends.

As discussed herein, the debris fin 212 may include any combination of features discussed herein in relation to one or more of the examples of the debris fin 212. For example, the debris fin 212 may include any combination of overlays, debriding ribs, airflow body or surface designs/features, and/or any other features discussed herein. Further, the robotic cleaner dust cup 200 may include any combination of features discussed herein in relation to one or more of the examples of the robotic cleaner dust cup 200.

An example of a debris fin for a robotic cleaner dust cup, consistent with the present disclosure, may include a fin mount and an airflow body extending from the fin mount according to a divergence angle, the airflow body defining an airflow surface, the airflow body being configured to straighten fibrous debris entrained within air that is incident thereon.

In some instances, the airflow body may include one or more ribs extending from the airflow surface. In some instances, the airflow body may include one or more grooves defined in the airflow surface. In some instances, a trailing edge of the airflow body may define a wave shape. In some instances, the wave shape may be a square wave. In some instances, the wave shape may be a curved wave. In some instances, the airflow body may be non-planar. In some instances, the debris fin may further include an overlay, the overlay extending along at least a portion of the airflow body. In some instances, the debris fin may further include a debriding rib.

An example of a dust cup for a robotic cleaner, consistent with the present disclosure, may include a dust cup top, a dust cup base, one or more sidewalls extending between the dust cup top and the dust cup base, and a debris fin, at least a portion of the debris fin extending between the dust cup top and the dust cup base and in a direction of the dust cup base, the debris fin including an airflow body defining an airflow surface, the airflow body being configured to straighten fibrous debris entrained within air that is incident thereon.

In some instances, the dust cup may further include a robotic cleaner dust cup inlet defined in a corresponding one of the one or more sidewalls. In some instances, the airflow body may extend transverse to a central axis of the robotic cleaner dust cup inlet. In some instances, the dust cup may further include a robotic cleaner dust cup outlet defined in a corresponding one of the one or more sidewalls. In some instances, the dust cup may further include a flow directer proximate the robotic cleaner dust cup outlet, the flow directer being configured to urge air incident thereon in a direction away from the dust cup top. In some instances, the debris fin may include one or more ribs extending from the airflow surface. In some instances, the debris fin may include one or more grooves defined in the airflow surface. In some instances, a trailing edge of the debris fin may define a wave shape. In some instances, the wave shape may be a square wave. In some instances, the wave shape may be a curved wave. In some instances, the debris fin may be non-planar. In some instances, the debris fin further may further include an overlay, the overlay extending along at least a portion of the airflow body. In some instances, the debris fin may include a debriding rib.

An example of a cleaning system, consistent with the present disclosure, may include a docking station and a robotic cleaner configured to fluidly couple to the docking station. The robotic cleaner may include a robotic cleaner dust cup. The robotic cleaner dust cup may include a dust cup body, an openable door moveably coupled to the dust cup body, and a debris fin extending within the dust cup body, the debris fin including an airflow body defining an airflow surface, the airflow body being configured to straighten fibrous debris entrained within air that is incident thereon.

In some instances, the robotic cleaner dust cup may include a robotic cleaner dust cup inlet. In some instances, the airflow body may extend transverse to a central axis of the robotic cleaner dust cup inlet. In some instances, the robotic cleaner dust cup may include a robotic cleaner dust cup outlet. In some instances, the robotic cleaner dust cup may include a flow directer configured to urge air incident thereon in a direction away from the openable door. In some instances, the debris fin may include one or more ribs extending from the airflow surface. In some instances, the debris fin may include one or more grooves defined in the airflow surface. In some instances, a trailing edge of the debris fin may define a wave shape. In some instances, the wave shape may be a square wave. In some instances, the wave shape may be a curved wave. In some instances, the debris fin may be non-planar.

Another example of a dust cup for a robotic cleaner, consistent with the present disclosure, may include a dust cup top, a dust cup base, one or more sidewalls extending between the dust cup top and the dust cup base, and a flow directer being configured to urge air incident thereon in a direction away from the dust cup top.

Another example of a debris fin for a robotic cleaner dust cup, consistent with the present disclosure, may include a fin mount, an airflow body extending from the fin mount according to a divergence angle, the airflow body defining an airflow surface, the airflow body being configured to straighten fibrous debris entrained within air that is incident thereon, and an overlay extending along at least a portion of one or more of the fin mount and/or the airflow body.

In some instances, the airflow body may include one or more ribs extending from the airflow surface. In some instances, the airflow body may include one or more grooves defined in the airflow surface. In some instances, a trailing edge of the airflow body may define a wave shape. In some instances, the wave shape may be a square wave. In some instances, the wave shape may be a curved wave. In some instances, the airflow body may be non-planar.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A debris fin for a robotic cleaner dust cup having a dust cup body and an openable door moveably coupled to the dust cup body, the debris fin comprising:

a fin mount having a mounting surface; and an airflow body extending from the fin mount according to a divergence angle such that the airflow body and the fin mount define an airflow surface, the air flow surface opposite the mounting surface, the airflow body being configured to straighten fibrous debris entrained within air that is incident thereon; and an overlay disposed on at least a portion of the airflow surface of the airflow body, the overlay configured to reduce an intensity of sound generated by debris impacting the debris fin.

2. The debris fin of claim 1, wherein the airflow body includes one or more ribs extending from the airflow surface.

3. The debris fin of claim 1, wherein the airflow body includes one or more grooves defined in the airflow surface.

4. The debris fin of claim 1, wherein a trailing edge of the airflow body defines a wave shape.

5. The debris fin of claim 4, wherein the wave shape is a square wave.

6. The debris fin of claim 4, wherein the wave shape is a curved wave.

7. The debris fin of claim 1 further comprising a debriding rib.

8. The debris fin of claim 1, wherein the overlay is overmolded over at least a portion of the debris fin.

9. The debris fin of claim 1, wherein the overlay includes an elastic material.

10. The debris fin of claim 9, wherein the elastic material includes a rubber, a silicone, or a thermoplastic polyurethane (TPU).

11. The debris fin of claim 1, wherein the overlay includes a thermoplastic polyurethane having a Shore 40A hardness.

12. A dust cup for a robotic cleaner comprising:

a dust cup body having:

a dust cup base; and one or more sidewalls extending from the dust cup base at least partially defining a dust cup cavity;

an openable door pivotally coupled to the dust cup body; and a debris fin coupled to the openable door and extending in a direction of the dust cup base at a divergence angle, the debris fin including an airflow body defining an airflow surface, the airflow body being configured to straighten fibrous debris entrained within air that is incident thereon; and an overlay disposed on at least a portion of the airflow surface of the airflow body, the overlay configured to reduce an intensity of sound generated by debris impacting the debris fin.

13. The dust cup of claim 12 wherein further comprising a robotic cleaner dust cup inlet defined in a corresponding one of the one or more sidewalls define at least a portion of the robotic cleaner dust cup inlet.

14. The dust cup of claim 13, wherein the airflow body extends transverse to a central axis of the robotic cleaner dust cup inlet.

15. The dust cup of claim 13, further comprising a robotic cleaner dust cup outlet defined in a corresponding one of the one or more sidewalls.

16. The dust cup of claim 15, further comprising a flow director proximate the robotic cleaner dust cup outlet, the flow director being configured to urge air incident thereon in a direction away from the openable door.

17. The dust cup of claim 12, wherein the debris fin includes one or more ribs extending from the airflow surface.

18. The dust cup of claim 12, wherein the debris fin includes one or more grooves defined in the airflow surface.

19. The dust cup of claim 12, wherein a trailing edge of the debris fin defines a wave shape.

20. The dust cup of claim 19, wherein the wave shape is a square wave.

21. The dust cup of claim 19, wherein the wave shape is a curved wave.

22. The dust cup of claim 12, wherein the debris fin includes a debriding rib.

23. The dust cup of claim 12, wherein the debris fin further comprises an overlay, the overlay extending along at least a portion of the airflow body.

24. The dust cup of claim 12, wherein the overlay includes an elastic material.

25. The dust cup of claim 24, wherein the elastic material includes a rubber, a silicone, or a thermoplastic polyurethane (TPU).

26. The dust cup of claim 12, wherein the overlay includes a thermoplastic polyurethane having a Shore 40A hardness.

* * * * *